US012116233B2

(12) United States Patent
Tachibana et al.

(10) Patent No.: US 12,116,233 B2
(45) Date of Patent: Oct. 15, 2024

(54) DRIVE SWITCHING DEVICE, SHEET TRANSPORT DEVICE, AND IMAGE FORMING APPARATUS

(71) Applicant: FUJIFILM Business Innovation Corp., Tokyo (JP)

(72) Inventors: Kohei Tachibana, Kanagawa (JP); Yuya Shiokawa, Kanagawa (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 181 days.

(21) Appl. No.: 17/976,176

(22) Filed: Oct. 28, 2022

(65) Prior Publication Data

US 2023/0416028 A1 Dec. 28, 2023

(30) Foreign Application Priority Data

Jun. 22, 2022 (JP) ..... 2022-100626

(51) Int. Cl.
*B65H 7/00* (2006.01)

(52) U.S. Cl.
CPC ..... *B65H 7/00* (2013.01); *B65H 2402/441* (2013.01); *B65H 2403/51* (2013.01); *B65H 2403/70* (2013.01)

(58) Field of Classification Search
CPC ..... B65H 7/00; B65H 2402/441; B65H 2403/51; B65H 2403/70
USPC ..... 399/124
See application file for complete search history.

(56) References Cited

U.S. PATENT DOCUMENTS 6,185,390 B1 * 2/2001 Higeta ..... G03G 21/1867 399/167
7,184,688 B2 * 2/2007 Ishii ..... G03G 21/1821 399/119
7,899,387 B2 * 3/2011 Ogawa ..... G03G 15/6573 74/354
7,957,674 B2 * 6/2011 Yamaguchi ..... G03G 21/1633 399/21

(Continued)

FOREIGN PATENT DOCUMENTS

JP 2002-189377 A 7/2002
JP 2003-280489 A 10/2003
JP 2018-060119 A 4/2018

*Primary Examiner* — Leslie A Nicholson, III
(74) *Attorney, Agent, or Firm* — Oliff PLC

(57) ABSTRACT

A drive switching device includes: a covering member that is rotatably provided on a support shaft provided in a housing including a driver, and is rotatable from a closed position for covering an inside of the housing to an open position for exposing the inside of the housing; an input unit that is provided in the covering member, and receives an input of displacement caused by rotation of the covering member; a release member provided in a direction apart from the input unit inside the housing and including a cam that moves in conjunction with movement of the input unit, the release member being configured to, upon rotation of the covering member toward the open position, disconnect a drive transmission path of the driver by the cam; and multiple links connected to the input unit and the cam, the multiple links being configured to, upon rotation of the covering member, move the cam in an opposite direction to a direction in which the input unit is moved.

20 Claims, 19 Drawing Sheets

(56) References Cited

U.S. PATENT DOCUMENTS 8,611,783 B2 * 12/2013 Onuma ..... G03G 21/1633
200/320

* cited by examiner

DRIVE SWITCHING DEVICE, SHEET TRANSPORT DEVICE, AND IMAGE FORMING APPARATUS

CROSS-REFERENCE TO RELATED APPLICATIONS

This application is based on and claims priority under 35 USC 119 from Japanese Patent Application No. 2022-100626 filed Jun. 22, 2022.

BACKGROUND

(i) Technical Field

The present disclosure relates to a drive switching device, a sheet transport device, and an image forming apparatus.

(ii) Related Art

Japanese Unexamined Patent Application Publication No. 2002-189377 discloses an image forming apparatus that transfers a toner image to a sheet, then heats and pressurizes the sheet to fix the toner image, the image forming apparatus including: a heating unit that heats the sheet to which the toner image has been transferred; a fixing unit including a pressurizing unit that comes into pressure contact with the heating unit to transport the sheet while sandwiching the sheet with the heating unit; a drive unit that drives the pressurizing unit; and a covering openably and closably provided in an apparatus body. When the covering is opened, the drive of the pressurizing unit by the drive unit is released and the pressure contact between the heating unit of the fixing unit and the pressurizing unit is released.

Japanese Unexamined Patent Application Publication No. 2018-060119 discloses an image forming apparatus including: a first drive joint that transmits a rotational drive force to a first rotatable body having a rotational shaft; a second drive joint that transmits a rotational drive force to a second rotatable body having a rotational shaft; and a release member that releases connection between the first drive joint and the second drive joint with a differentiated timing.

Japanese Unexamined Patent Application Publication No. 2003-280489 discloses an image forming apparatus in which a unit having multiple drive transmitters is detachably attached to the apparatus body by opening or closing the covering of the exterior of the apparatus body. The image forming apparatus includes a drive transmission release mechanism that, upon detachment of the unit from the apparatus body, in conjunction with an operation of opening the covering, release connection of the multiple drive transmitters at the same time, and upon attachment of the unit to the apparatus body, in conjunction with an operation of closing the covering, connect the multiple drive transmitters at the same time.

SUMMARY

Aspects of non-limiting embodiments of the present disclosure relate to providing a drive switching device, a sheet transport device, and an image forming apparatus that prevent interference between an input unit and the frame of a housing on a rotational path of a covering member, as compared to the configuration in which an actuator as the input unit is fixed to the covering member to cause a release member to operate.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a drive switching device including: a covering member that is rotatably provided on a support shaft provided in a housing including a driver, and is rotatable from a closed position for covering an inside of the housing to an open position for exposing the inside of the housing; an input unit that is provided in the covering member, and receives an input of displacement caused by rotation of the covering member; a release member provided in a direction apart from the input unit inside the housing and including a cam that moves in conjunction with movement of the input unit, the release member being configured to, upon rotation of the covering member toward the open position, disconnect a drive transmission path of the driver by the cam; and a plurality of links connected to the input unit and the cam, the plurality of links being configured to, upon rotation of the covering member, move the cam in an opposite direction to a direction in which the input unit is moved.

BRIEF DESCRIPTION OF THE DRAWINGS

Exemplary embodiment of the present disclosure will be described in detail based on the following figures, wherein.

DETAILED DESCRIPTION

Figure 1:
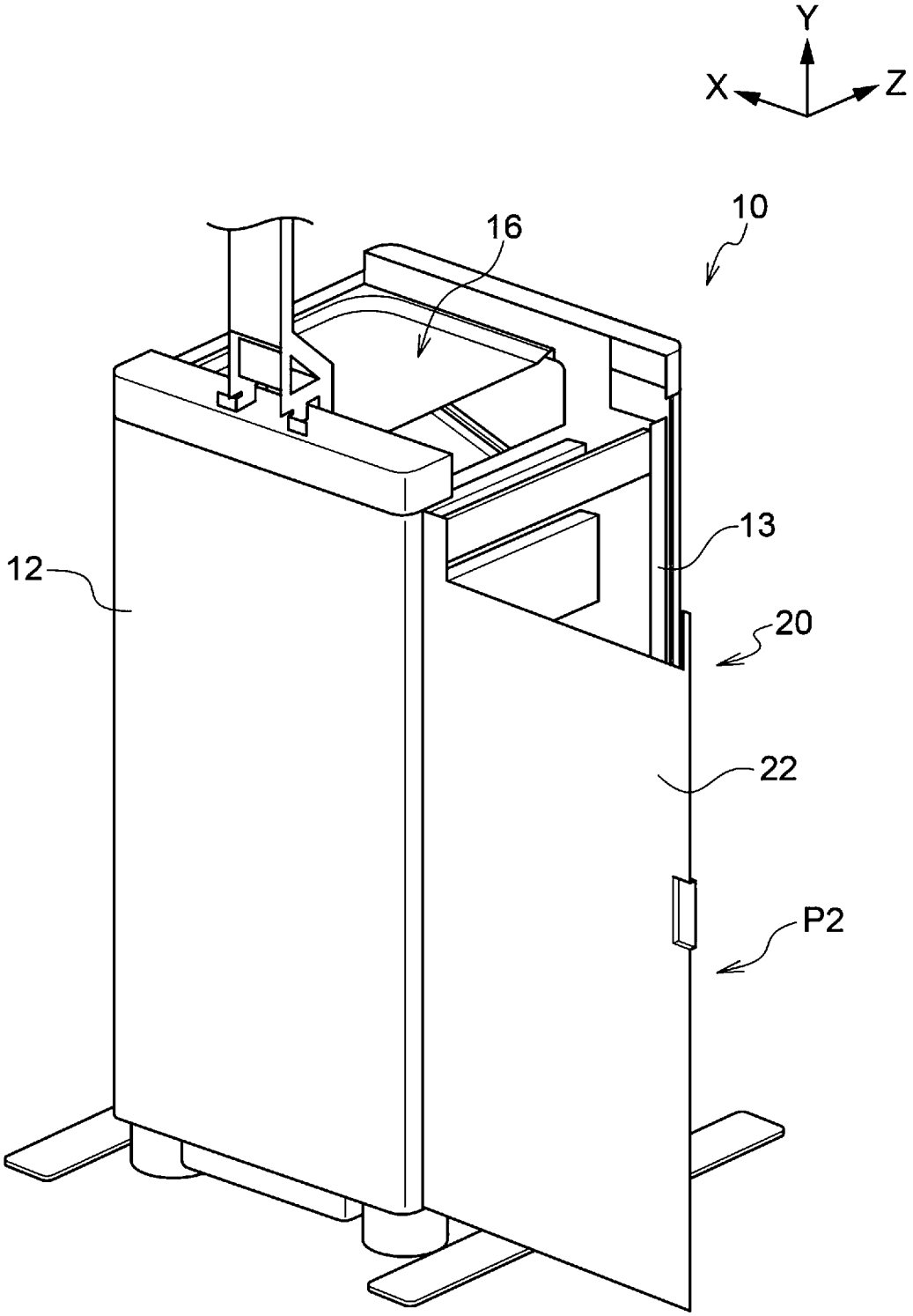
FIG. 1 is a schematic perspective view illustrating an appearance of an image forming apparatus including a drive switching device according to a first exemplary embodiment.

Hereinafter, an exemplary embodiment of the present disclosure will be described in detail with reference to the drawings. Note that an arrow X shown in the drawings indicates a horizontal direction that is an apparatus width direction, an arrow Y indicates a vertical direction that is an apparatus up-down direction, and an arrow Z indicates a horizontal direction that is an apparatus depth direction. In the description of each drawing, the side in arrow X direction may be denoted by +X side, and the opposite side in arrow X direction may be denoted by −X side. Similarly, the side in arrow Y direction may be denoted by +Y side, and the opposite side in arrow Y direction may be denoted by −Y side. Similarly, the side in arrow Z direction may be denoted by +Z side, and the opposite side in arrow Z direction may be denoted by −Z side.

<First Exemplary Embodiment>

FIG. 1 is a schematic perspective view illustrating an example of an appearance of an image forming apparatus including a drive switching device according to a first exemplary embodiment.

As illustrated in FIG. 1, an image forming apparatus 10 includes a housing 12, and a drive switching device 20 that switches between drive. The drive switching device 20 includes a covering 22 to open and close an opening 13 in a lateral face of the housing 12. The covering 22 is an example of a covering member. The covering 22 is rotatable between a closed position P1 (see FIG. 3) for covering the inside of the housing 12 and an open position P2 (see FIG. 1) for exposing the inside of the housing 12. In the image forming apparatus 10, as an example, a front side is a state when viewed from +Z side in the apparatus depth direction (Z direction) illustrated in FIG. 1.

[Housing 12]

As illustrated in FIG. 1, the housing 12 is formed in a vertically elongated rectangular parallelepiped shape. When viewed from the front side (+Z side) of the housing 12, the opening 13 is provided in the lateral face on the left side (−X side) in the width direction of the housing 12. The upper portion of the housing 12 is provided with a document reader 16 that reads a document. Although illustration is omitted, the inside of the housing 12 is provided with an image former. The image former forms a copy image of a document based on electronic data of an image read by the document reader 16, and records the copy image on a sheet member as an example of a recording medium. Although illustration is omitted, the inside of the housing 12 is provided with a sheet transport device including a transporter that transports a sheet member to the image former. The sheet member with a copy image recorded by the image former is discharged to a discharge unit (not illustrated) provided in the housing 12.

The image former may use either one of a method of forming a copy image on a sheet member by an electrophotographic system or a method of forming a copy image on a sheet member by an ink jet recording system. As an example, the image former uses a method of forming a copy image on a sheet member by an electrophotographic system. Although illustration is omitted, for example, an electrostatic latent image is formed on a photoreceptor by the image former based on electronic data of an image, the electrostatic latent image on the photoreceptor is developed by a developing device to form a toner image, and the toner image is transferred to a sheet member directly or via an intermediate transfer body. The toner image on the sheet member is fixed with heat and pressure by a fixing part, and a sheet member with a copy image formed is discharged to a discharge unit.

Figure 2:
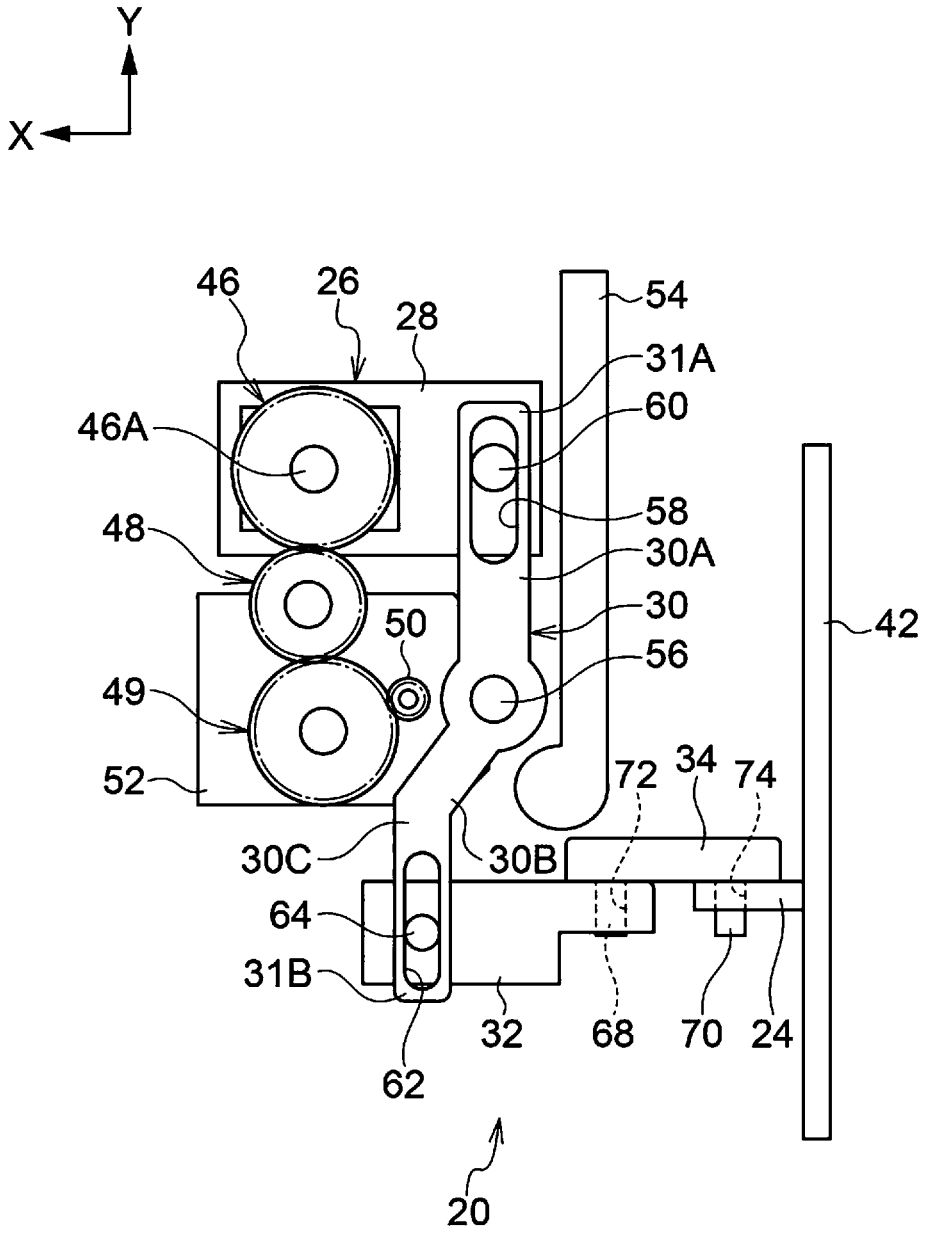
FIG. 2 is a schematic configuration view illustrating the drive switching device according to the first exemplary embodiment when viewed in an apparatus depth direction (Z direction)
Figure 3:
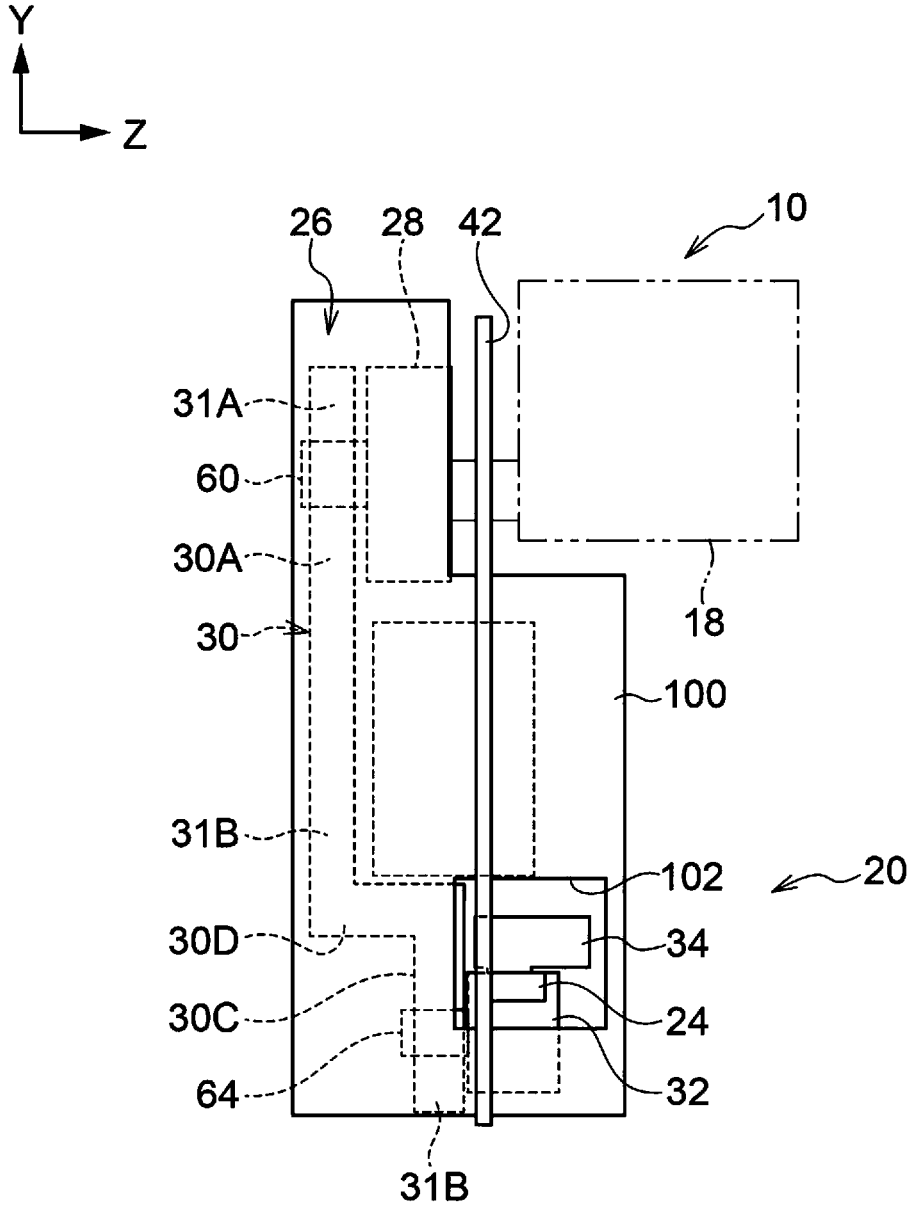
FIG. 3 is a schematic configuration view illustrating a joint and a release member of the drive switching device according to the first exemplary embodiment.

As illustrated in FIG. 3, the image forming apparatus 10 is provided with a fixing unit 18 as an example of a fixing part inside the housing 12. The fixing unit 18 is configured to cause the members in the fixing unit 18 to operate by driving an input gear 46 (see FIG. 2) that constitutes part of a driver, and to fix a toner image formed on a sheet member.

[Drive Switching Device 20]

Figure 4:
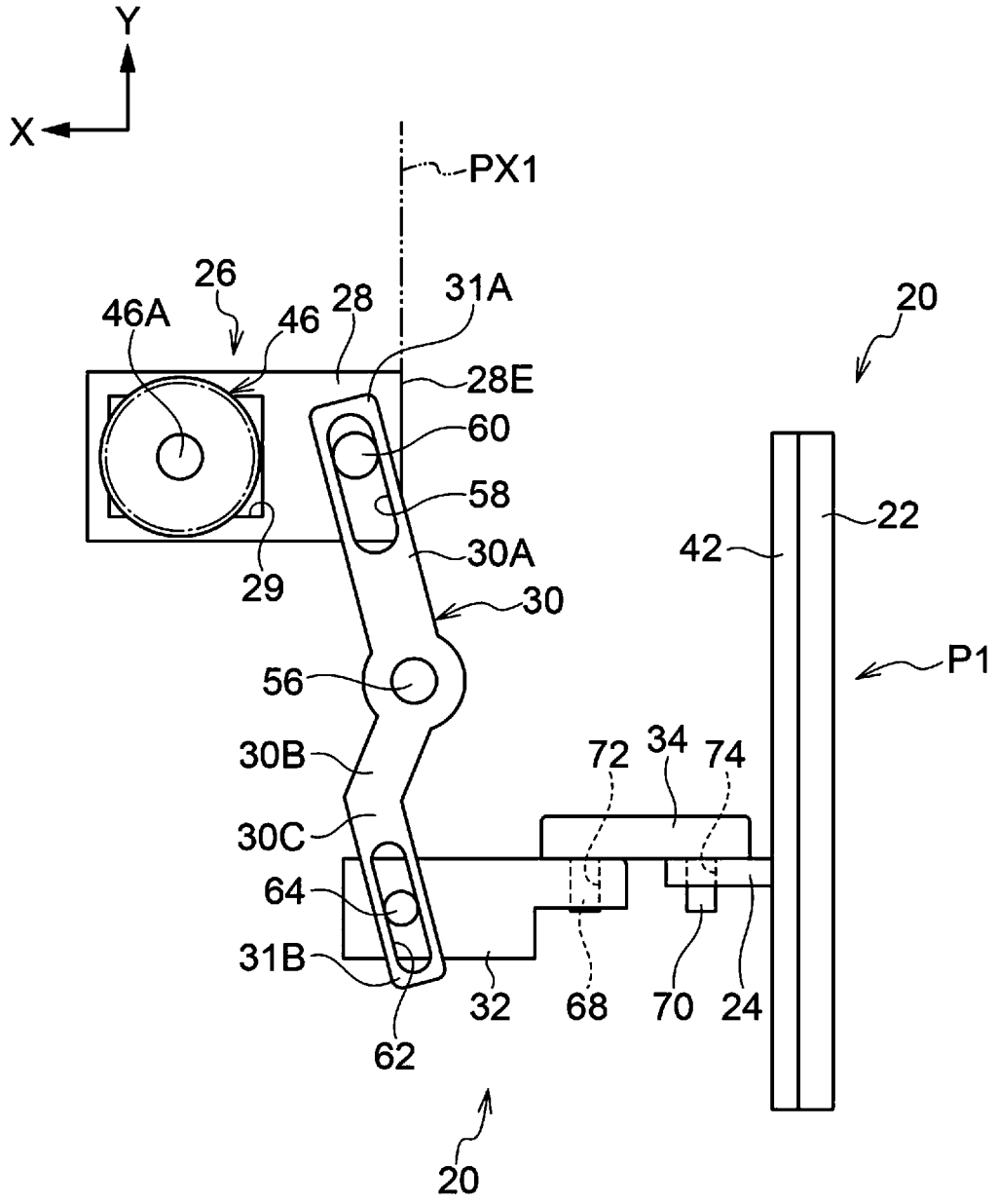
FIG. 4 is a schematic configuration view illustrating a state of connection of the drive switching device according to the first exemplary embodiment when viewed in the apparatus depth direction (Z direction)

The drive switching device 20 has a function of achieving a connected state in which a drive transmission path of the input gear 46 is connected where a covering 22 is rotated to be at a closed position P1 (see FIG. 4). In addition, the drive switching device 20 has a function of achieving a released state in which the drive transmission path of the input gear 46 is disconnected in a process of rotation of the covering 22 to the open position P2 (see FIG. 1). As illustrated in FIG. 2, the drive switching device 20 includes a joint 24 as an example of an input unit provided in the covering 22, and a release member 26 including a guide cam 28. In addition, the drive switching device 20 includes a first link 30, a second link 32, and a third link 34 as an example of multiple links connected to the guide cam 28 and the joint 24. The guide cam 28 is an example of a cam.

(Covering 22)

As illustrated in FIG. 1, as an example, the covering 22 is a left-side covering to open or close the opening 13 in the lateral face on the left side (−X side) of the housing 12 in the width direction when viewed from the front side (+Z side) of the housing 12. As illustrated in FIGS. 2 and 3, the covering 22 is rotatably supported by a support shaft 42 provided in the housing 12. As an example, the support shaft 42 is disposed in the up-down direction (Y direction) of the housing 12 on the depth side (−Z side) in the depth direction (Z direction) of the housing 12. Thus, the covering 22 is opened and closed in a horizontal direction around the support shaft 42 on the depth side (−Z side) in the depth direction of the housing 12. In other words, the covering 22 is opened horizontally.

(Joint 24)

Figure 5:
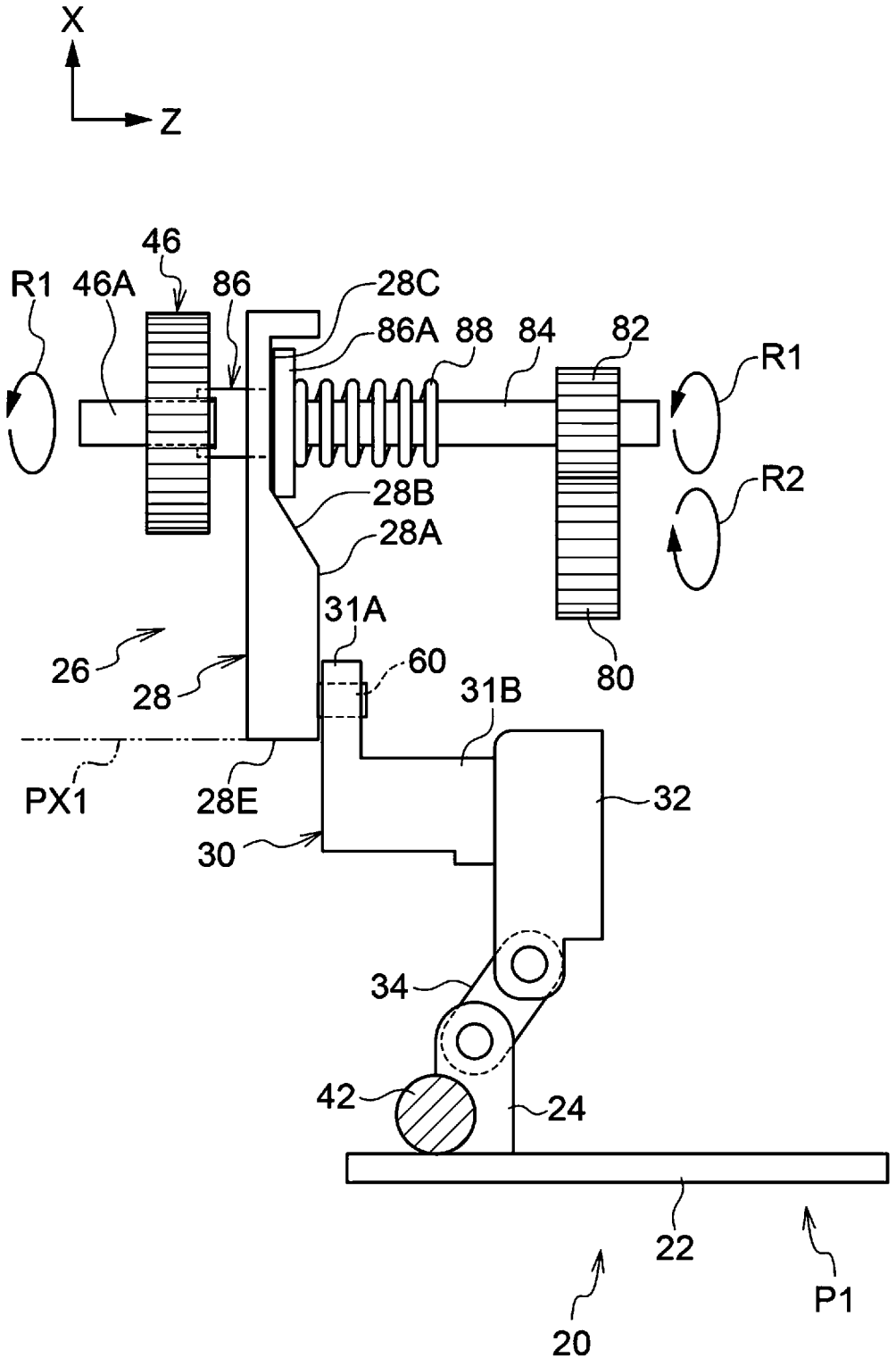
FIG. 5 is a schematic configuration view illustrating a state of connection of the drive switching device according to the first exemplary embodiment when viewed in an apparatus up-down direction (Y direction)

As illustrated in FIGS. 4 and 5, the joint 24 is fixed to the rear surface of the covering 22, and rotates integrally with the covering 22. As an example, the joint 24 is attached to the rear surface of the covering 22 in a horizontal direction. The joint 24 is a plate material, and projects in a direction (as an example, a direction perpendicular to the rear surface of the covering 22) crossing the rear surface of the covering 22 when viewed in the up-down direction (Y direction). The joint 24 is formed in a U-shape when viewed in the up-down direction (Y direction) (see FIG. 5).

The joint 24 inputs a displacement (for example, a displacement when the covering 22 is rotated in a direction to the open position P2 (see FIG. 1)) caused by rotation of the covering 22 to the third link 34. In the first exemplary embodiment, the joint 24 rotates integrally with the covering 22, thus the rotation of the covering 22 in a direction to the open position P2 (see FIG. 1) is input from the joint 24 to the third link 34.

(Release Member 26)

The release member 26 has a function of disconnecting the drive transmission path of the input gear 46. In other words, the release member 26 has a function of releasing the drive of the input gear 46. As illustrated in FIGS. 2 to 4, the release member 26 is provided in a direction apart from the joint 24 inside the housing 12. As an example, the joint 24 and the release member 26 are disposed at positions apart in the up-down direction (Y direction) of the housing 12 (see FIGS. 2 and 3). In the first exemplary embodiment, the release member 26 is provided on the upper side (+Y side) of the joint 24 in the up-down direction. The release member 26 includes the guide cam 28 that moves in conjunction with the movement of the joint 24. The release member 26 is configured to, upon rotation of the covering 22 toward the open position P2, disconnect the drive transmission path of the input gear 46 (in other words, release the drive of the input gear 46) by the guide cam 28.

As illustrated in FIG. 2, the lateral side of the guide cam 28 is provided with the input gear 46 which is connected via the later-described coupling 86. The input gear 46 includes a shaft 46A, and rotates around the shaft 46A. As an example, the input gear 46 is engaged with a first gear 48 which is engaged with a second gear 49 which is engaged with a third gear 50. The first gear 48, the second gear 49, and the third gear 50 are rotatably supported by a mounting plate 52. The mounting plate 52 is mounted on a frame 100 (see FIG. 3) disposed inside the housing 12. As an example, the inside of the housing 12 is provided with a motor which is not illustrated, and the rotational force of the motor is transmitted to the input gear 46 through the third gear 50, the second gear 49 and the first gear 48. In addition, a component 54 that constitutes part of the image former is provided in the periphery of the first link 30.

As illustrated in FIG. 3, the joint 24 is disposed on one side (+Z side) with respect to the support shaft 42 in the depth direction (Z direction) of the housing 12 when viewed in a covering direction of the covering 22 (in other words, when viewed from −X side). The release member 26 is disposed on the other side (−Z side) with respect to the support shaft 42 in the depth direction (Z direction) of the housing 12. The guide cam 28 is horizontally movably supported by a support member which is not illustrated.

Figure 6:
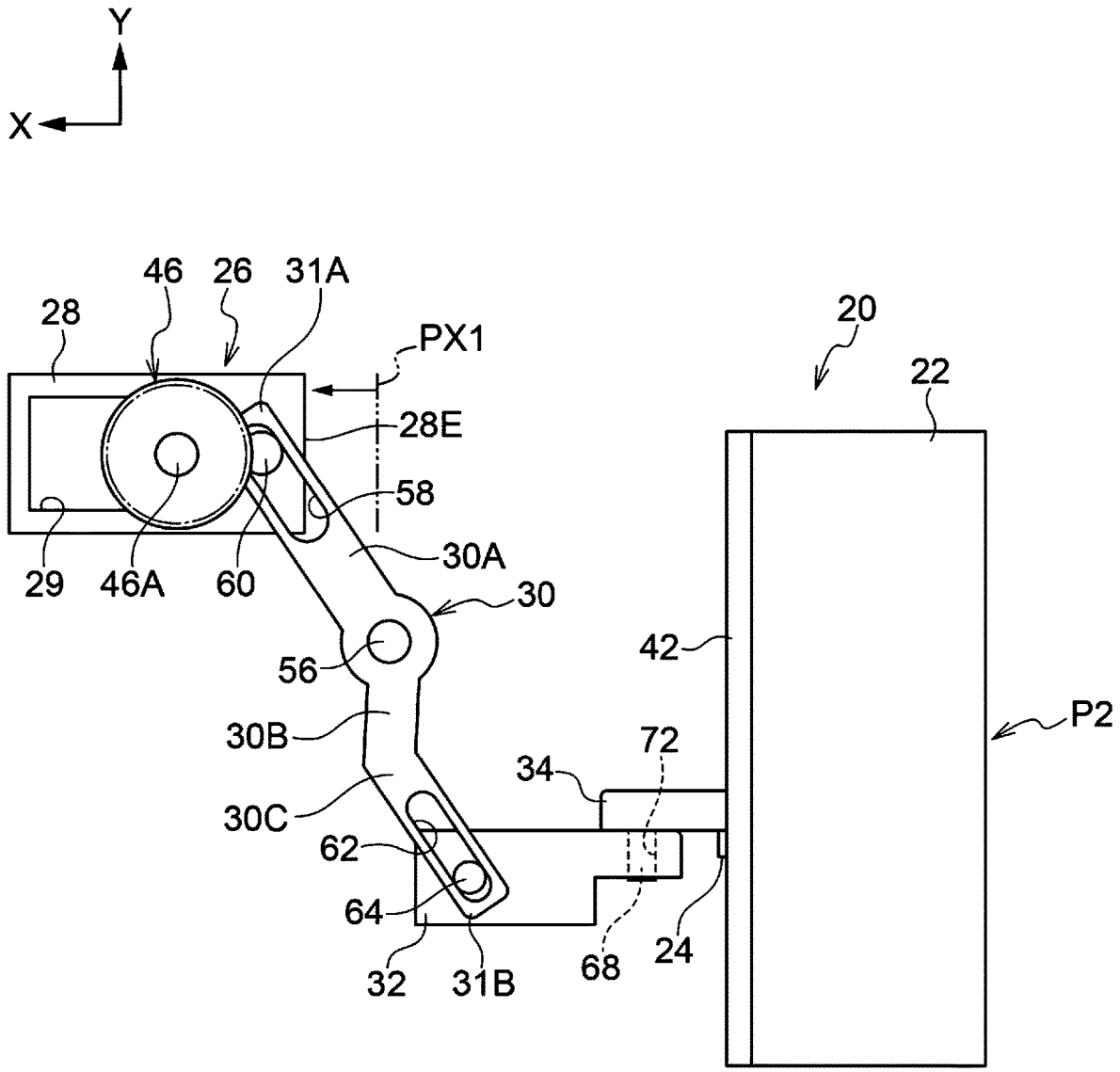
FIG. 6 is a schematic configuration view illustrating a state of release of the drive switching device according to the first exemplary embodiment when viewed in the apparatus depth direction (Z direction)

In FIGS. 4 and 5, a connected state is illustrated in which the drive transmission path of the input gear 46 is connected in the drive switching device 20. As illustrated in FIG. 4, the drive switching device 20 is in a connected state in which the drive transmission path of the input gear 46 is connected where the covering 22 is rotated to be at the closed position P1 (see FIG. 3). As illustrated in FIG. 6, the inside of the housing 12 is provided with a gear 80 to cause the fixing unit 18 (see FIG. 2) to operate.

Figure 7:
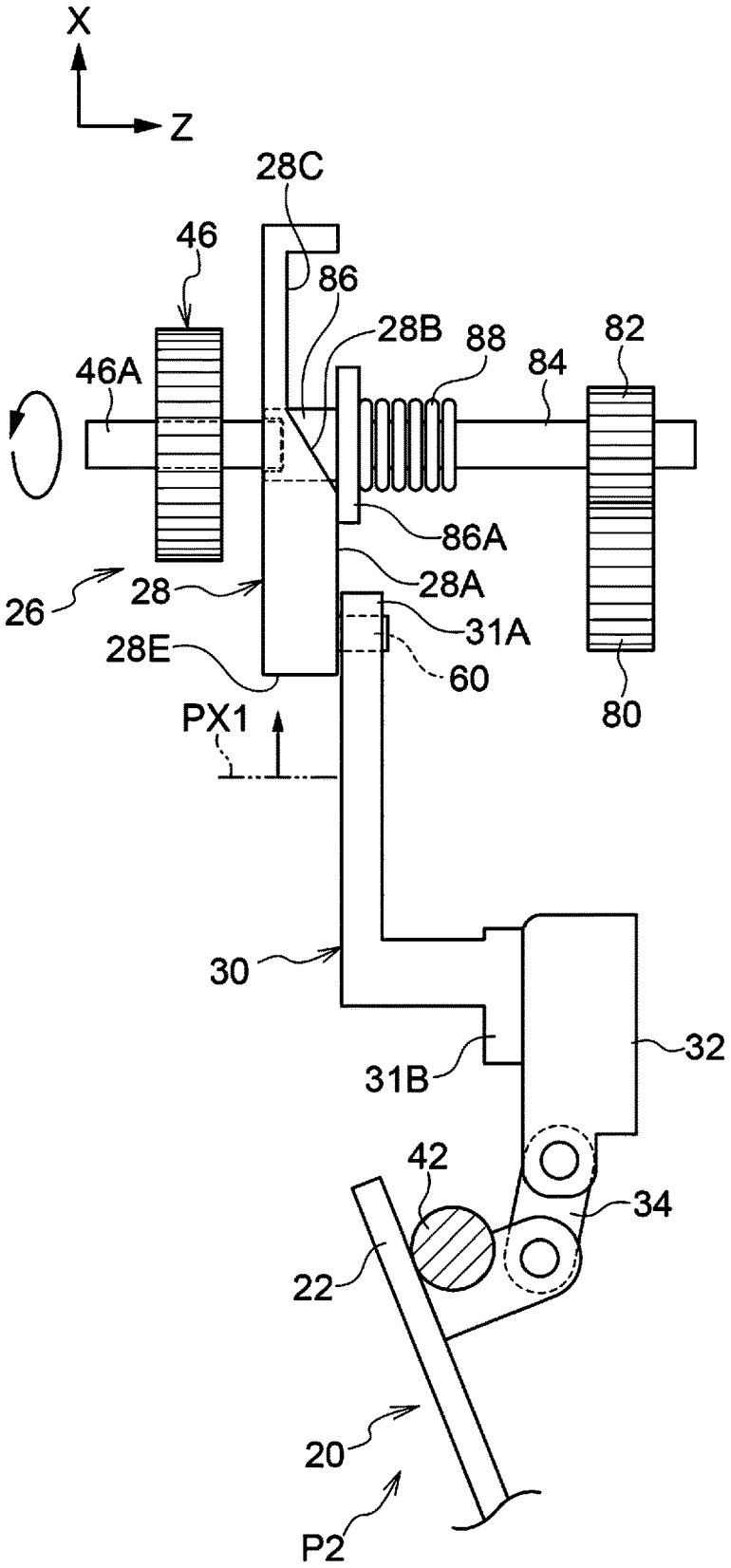
FIG. 7 is a schematic configuration view illustrating a state of release of the drive switching device according to the first exemplary embodiment when viewed in the apparatus up-down direction (Y direction)

In FIGS. 6 and 7, a released state is illustrated in which the drive transmission path of the input gear 46 is disconnected in the drive switching device 20. As illustrated in FIG. 6, the drive switching device 20 is in a released state in which the drive transmission path of the input gear 46 is disconnected in a process of rotation of the covering 22 to the open position P2 (see FIG. 1), in other words, a released state in which the drive of the input gear 46 is released.

As illustrated in FIGS. 5 and 7, the release member 26 includes a delivery gear 82 engaged with the gear 80 of the fixing unit 18 (see FIG. 3), and a shaft 84 that rotates the delivery gear 82. In addition, the release member 26 includes a coupling 86 axially movably supported at an axial end (the end on the opposite side to the delivery gear 82) of the shaft 84, and a coil spring 88 as an urging member wound over the shaft 84. The guide cam 28 is provided with an opening 29 through which the coupling 86 penetrates (see FIG. 6). The coupling 86 has, at one axial end, a recess to be engaged with the shaft 46A of the input gear 46. In addition, the coupling 86 has a flange 86A at the other axial end (near the delivery gear 82). The shaft 84 is passed through the coil spring 88. One end of the coil spring 88 is in contact with a projection (not illustrated) at an axially intermediate point of the shaft 84, and the other end of the coil spring 88 is in contact with the flange 86A. The coupling 86 is pressed against the guide cam 28 by a force of the coil spring 88.

As illustrated in FIGS. 5 and 7, the guide cam 28 includes, on its surface (surface on +Z side) opposed to the gear 80, a first planar section 28A, an inclined section 28B, and a second planar section 28C in that order from the side of the support shaft 42. The first planar section 28A extends in the Y direction and the X direction. The inclined section 28B is inclined in an opposite direction (that is, −Z side) to the delivery gear 82 from the end (the end on the opposite side to the support shaft 42) of the first planar section 28A. The angle formed by the first planar section 28A and the inclined section 28B is an obtuse angle. The second planar section 28C extends in an opposite direction (+X side) to the first planar section 28A from the end (the end on the opposite side to the support shaft 42) of the inclined section 28B. The second planar section 28C is parallel to the extension line of the first planar section 28A. The space between the first planar section 28A and the gear 80 is smaller than the space between the second planar section 28C and the extension line (the delivery gear 82 in the first exemplary embodiment) of the gear 80.

As illustrated in FIGS. 4 to 7, the covering 22 is rotated in a direction from the closed position P1 to the open position P2, thus an operation of the third link 34, the second link 32 and the first link 30 in conjunction with the displacement of the joint 24 causes the guide cam 28 to move to +X side in the width direction (X direction) of the housing 12. The coupling 86 penetrates the opening 29 of the guide cam 28 (see FIG. 5). Thus, as illustrated in FIGS. 5 and 7, the coupling 86 comes into contact with the first planar section 28A, the inclined section 28B, and the second planar section 28C along with the movement of the guide cam 28, thus is movable to +Z side in the Z direction.

As illustrated in FIGS. 4 and 5, in a state where the covering 22 is rotated to be at the closed position P1, a front face 28E (the face near the covering 22) of the guide cam 28 is disposed at a first position PX1 in the width direction (X direction) of the housing 12. In this state, as illustrated in FIG. 5, the flange 86A of the coupling 86 is in contact with the second planar section 28C of the guide cam 28, and the coupling 86 is connected to the shaft 46A of the input gear 46. In other words, the recess of the coupling 86 is engaged with the shaft 46A. Thus, the delivery gear 82 rotates in an arrow R1 direction along with the rotation of the input gear 46 in the arrow R1 direction, and the gear 80 to be engaged with the delivery gear 82 rotates in an arrow R2 direction. In other words, the rotational force of the input gear 46 is transmitted to the gear 80 through the delivery gear 82.

As illustrated in FIGS. 6 and 7, in a state where the covering 22 is rotated to be at the open position P2, the front face 28E (the face near the covering 22) of the guide cam 28 has moved from the first position PX1 to +X side in the width direction (X direction) of the housing 12. In this state, as illustrated in FIG. 7, the flange 86A of the coupling 86 is in contact with the first planar section 28A of the guide cam 28, and the coupling 86 has moved in a direction away from the input gear 46. Thus, the connection between the coupling 86 and the shaft 46A of the input gear 46 is released. In other words, engagement between the recess of the coupling 86 and the shaft 46A is released. In this state, even if the input gear 46 rotates in the arrow R1 direction, the rotational force of the input gear 46 is not transmitted to the delivery gear 82.

(First Link 30, Second Link 32, and Third Link 34)

The first link 30, the second link 32, and the third link 34 have a function of moving the guide cam 28 in conjunction with the movement of the joint 24. In the first exemplary embodiment, the first link 30, the second link 32, and the third link 34 have a function of, upon rotation of the covering 22, moving the guide cam 28 in the direction opposite to the direction in which the joint 24 moves.

As illustrated in FIG. 4, the first link 30, the second link 32, and the third link 34 are disposed in that order between the guide cam 28 and the joint 24, thus are connected to the guide cam 28 and the joint 24. As an example, the first link 30, the second link 32, the third link 34 are disposed in that order from the guide cam 28 toward the joint unit 24. In the first exemplary embodiment, the first link 30 is connected to the guide cam 28, the second link 32 is connected to the first link 30, the third link 34 is connected to the second link 32, and the third link 34 is connected to the joint 24.

More specifically, as an example, the first link has a length in the up-down direction (Y direction). The first link 30 is supported rotatably around a fulcrum 56 disposed at an intermediate point in a longitudinal direction. In the first exemplary embodiment, the fulcrum 56 is a cylindrical shaft that rotates the first link 30. The axial direction of the fulcrum 56 is along the apparatus depth direction (Z direction). The first link 30 moves the guide cam 28 connected to one side of the fulcrum 56. The second link 32 is connected to the other side of the fulcrum 56 in the first link 30.

As illustrated in FIG. 4, as an example, the first link 30 is curved at one side and the other side of the fulcrum 56 when viewed in the axial direction of the fulcrum 56 (in other words, when viewed in the Z direction). In the first exemplary embodiment, the first link 30 is formed in a crank shape when viewed in the axial direction of the fulcrum 56 (in other words, when viewed in the Z direction). The first link 30 includes a long plate-shaped section 30A extending in one direction from the fulcrum 56, and a plate-shaped inclined section 30B that is inclined from the end, closer to the fulcrum 56, of the plate-shaped section 30A so as to form an obtuse angle with respect to the axial direction of the plate-shaped section 30A. In addition, the first link 30 includes a long plate-shaped section 30C extending from an end of the inclined section 30B in an opposite direction to the plate-shaped section 30A. The longitudinal extension line of the plate-shaped section 30A and the longitudinal direction of the plate-shaped section are parallel or substantially parallel.

As illustrated in FIG. 3, when viewed in a covering direction of the covering 22 (in other words, when viewed from −X side in the X direction), the first link 30 is provided with a step 30D between the plate-shaped section 30A to be connected to the guide cam 28 and the plate-shaped section 30C to be connected to the second link 32. Since the step 30D is provided, the plate-shaped section 30C is disposed on +Z side of the plate-shaped section 30A.

As illustrated in FIG. 4, as an example, an end 31A of the first link 30 on one side of the fulcrum 56, in other words, the end 31A of the plate-shaped section 30A is provided with a first long hole 58. For example, the first long hole 58 is oval. The longitudinal direction of the first long hole 58 is along the longitudinal direction of the plate-shaped section 30A. The guide cam 28 is provided with a cylindrical first projection 60 which is inserted in the first long hole 58. Thus, in a state where the first projection 60 of the guide cam 28 is inserted in the first long hole 58 of the first link 30, the first projection 60 is relatively movable in the longitudinal direction of the first long hole 58 according to the movement of the first link 30.

As an example, an end 31B of the first link 30 on the other side of the fulcrum 56, in other words, the plate-shaped section 30C is provided with a second long hole 62. For example, the second long hole 62 is oval. The longitudinal direction of the second long hole 62 is along the longitudinal direction of the plate-shaped section 30C. The second link 32 is provided with a cylindrical second projection 64 which is inserted in the second long hole 62. Thus, in a state where the second projection 64 of the second link 32 is inserted in the second long hole 62 of the first link 30, the second projection 64 is relatively movable in the longitudinal direction of the second long hole 62 according to the movement of the second link 32.

As an example, the direction of the first long hole 58 is aligned with the direction of the second long hole 62 in the first link 30. In the first exemplary embodiment, the fulcrum 56 is provided in an extended area of the first long hole 58 in the first link 30, but is displaced from an extended area of the second long hole 62.

As illustrated in FIG. 4, as an example, the second link 32 has a length in a horizontal direction. One longitudinal end of the second link 32 is connected to the first link 30. The other longitudinal end of the second link 32 is connected to the third link 34. The second link 32 is horizontally movably supported by a support member which is not illustrated.

As illustrated in FIG. 4, the third link 34 is connected to the second link 32 and the joint 24, and rotatably supported thereby. As an example, the third link 34 has a length in a horizontal direction. One longitudinal end of the third link 34 is connected to the second link 32, and the other longitudinal end of the third link 34 is connected to the joint 24. In the first exemplary embodiment, the third link 34 is only rotatably supported by the second link 32 and the joint 24. In other words, the third link 34 does not relatively move in an axial direction with respect to a rotational section of the second link 32 or the joint 24.

The third link 34 includes a cylindrical projection 68 provided at one longitudinal end thereof, and a cylindrical projection 70 provided at the other longitudinal end. As an example, the projection 68 and the projection 70 project to the lower side (−Y side) from the lower surface of the third link 34. The projection 68 of the third link 34 is inserted into a circular hole 72 formed at the other end of the second link 32, thus the third link 34 is rotatably supported by the second link 32. The projection 70 of the third link 34 is inserted into a circular hole 74 formed at the front side (the opposite side to the covering 22) of the joint 24, thus the third link 34 is rotatably supported by the joint 24.

As illustrated in FIGS. 4 to 7, when the covering 22 is rotated in a direction from the closed position P1 to the open position P2, the third link 34 rotates relative to the joint 24 due to displacement of the joint 24 fixed to the covering 22. Along with the rotation of the third link 34, the second link 32 rotates relative to the third link 34. Along with the rotation of the second link 32, the first link 30 rotates relative to the second link 32, and the first link 30 moves relative to and along the second long hole 62. Furthermore, along with the movement of the first link 30, the guide cam 28 rotates relative to the first link 30 and the guide cam 28 moves relative to and along the first long hole 58. Thus, when the covering 22 is rotated in a direction from the closed position P1 to the open position P2, the first link 30, the second link 32 and the third link 34 cause the guide cam 28 to move in an opposite direction (for example, +X side) to the direction (for example, −X side) in which the joint 24 moves.

Figure 8A:
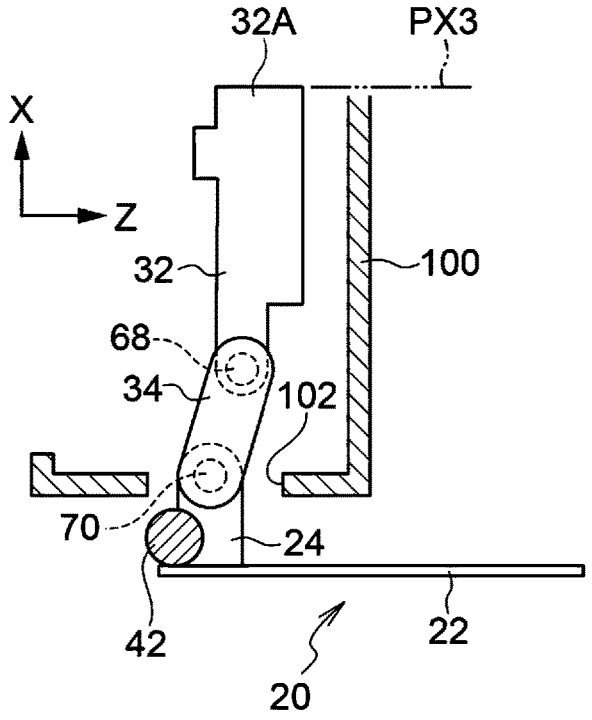
FIGS. 8A to 8D are schematic configuration views illustrating movement of a joint, a third link and a second link in a process of opening a covering when viewed in the apparatus up-down direction (Y direction) in the drive switching device according to the first exemplary embodiment.
Figure 8B:
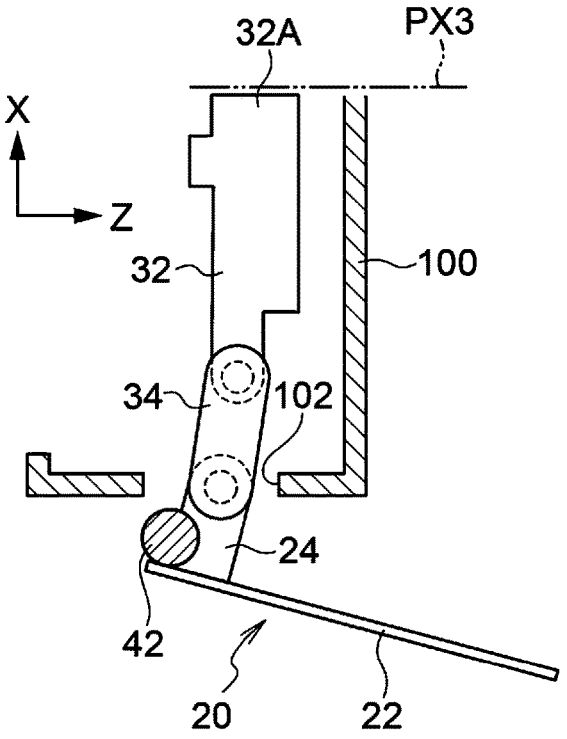
Figure 8C:
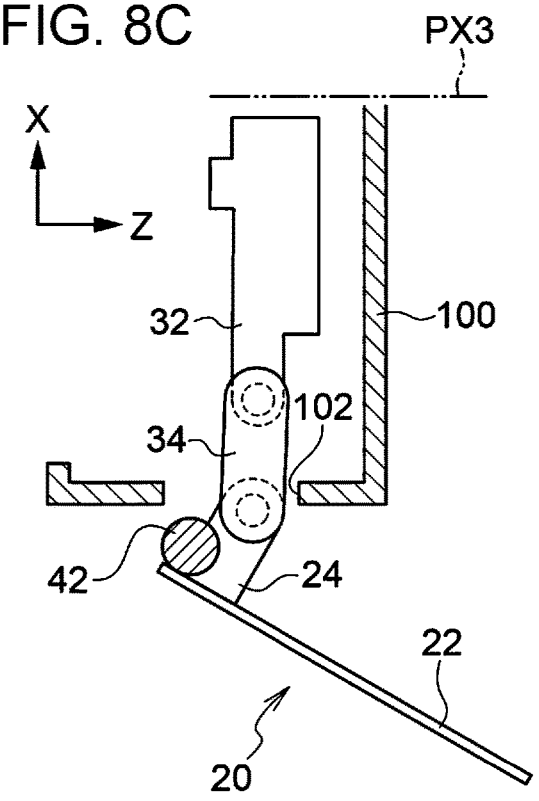
Figure 8D:
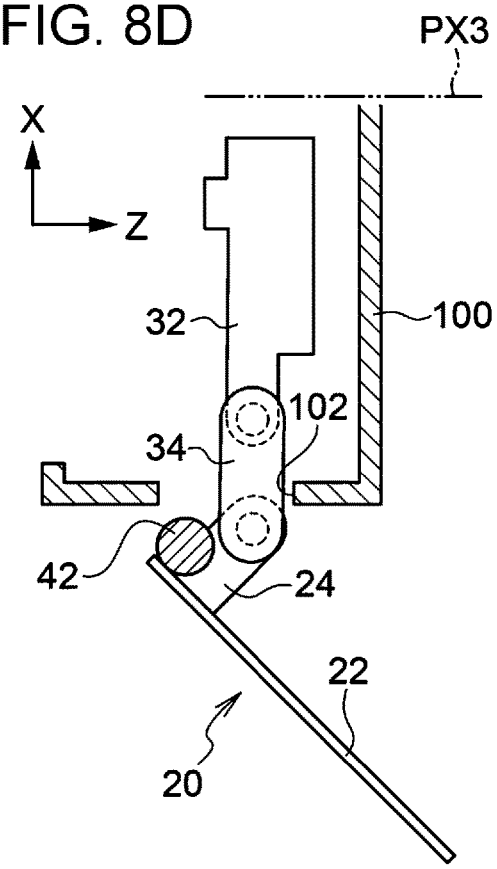
Figure 8E:
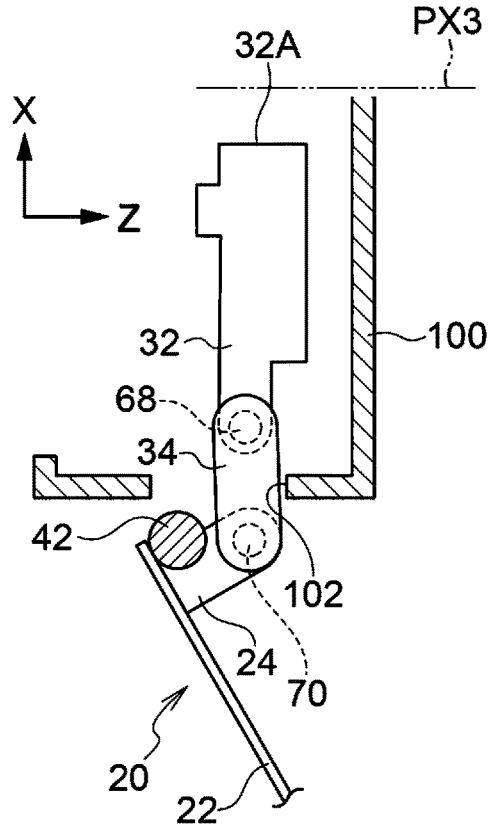
FIGS. 8E to 8G are schematic configuration views illustrating movement of the joint, the third link and the second link in a process of opening a covering when viewed in the apparatus up-down direction (Y direction) in the drive switching device according to the first exemplary embodiment.
Figure 8F:
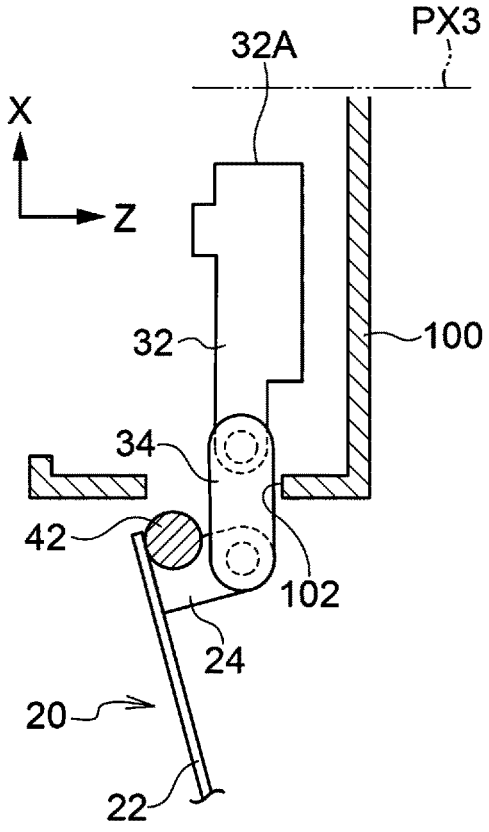
Figure 8G:
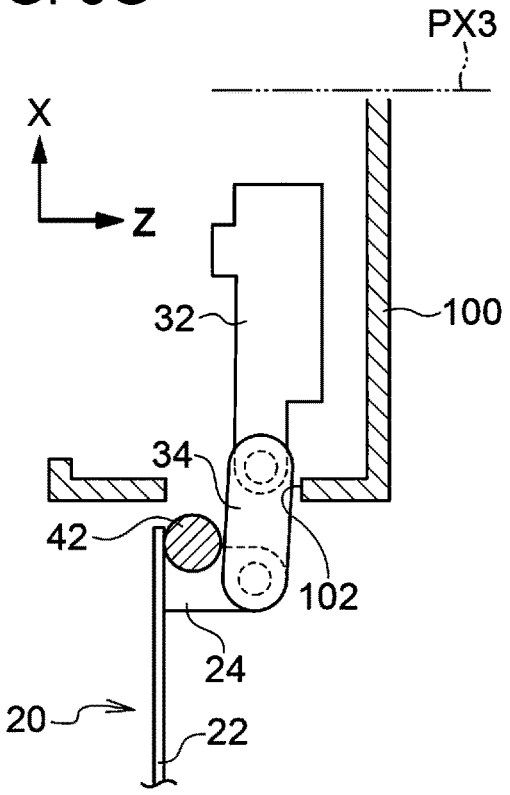
Figure 9A:
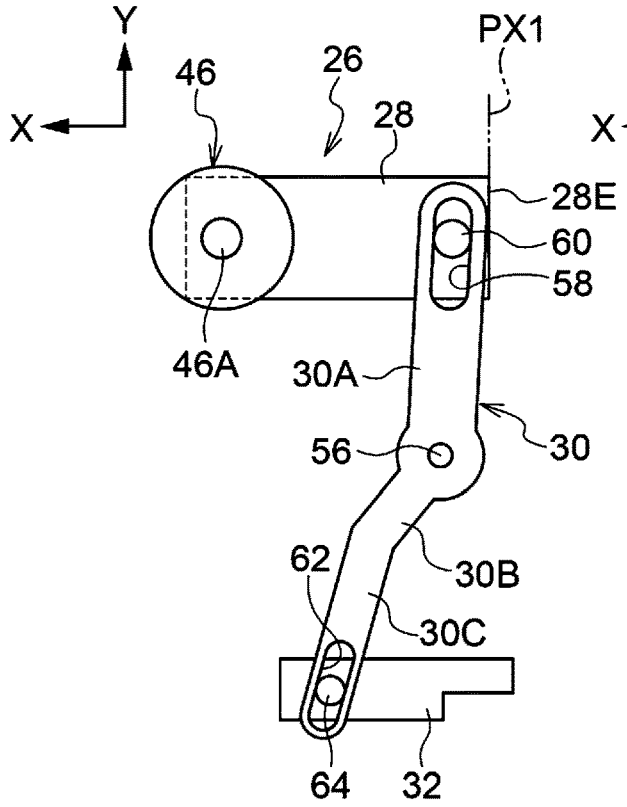
FIGS. 9A to 9D are schematic configuration views illustrating movement of the second link, a first link and a guide cam in a process of opening a covering when viewed in the apparatus depth direction (Z direction)
Figure 9B:
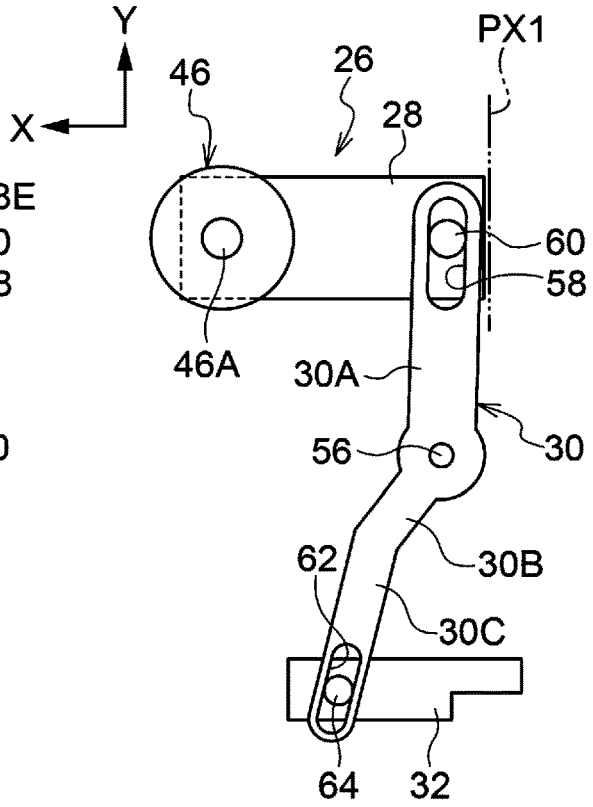
Figure 9C:
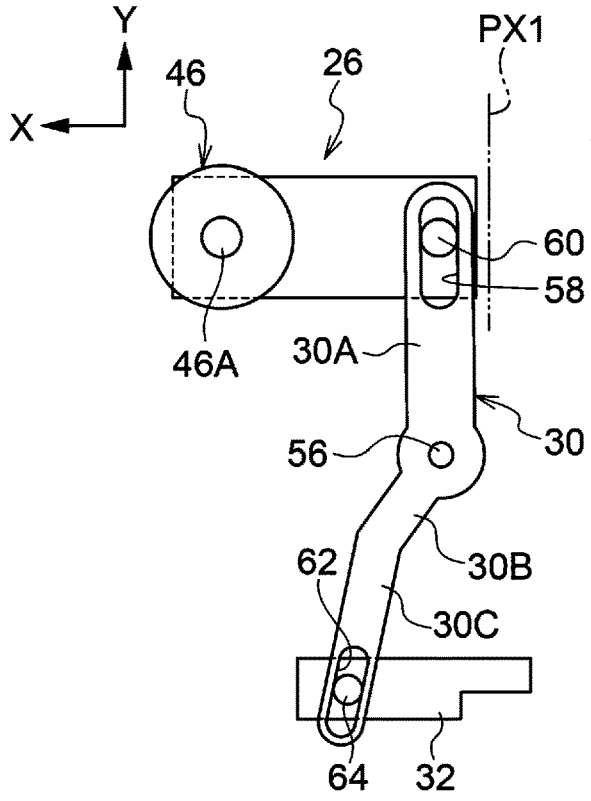
Figure 9D:
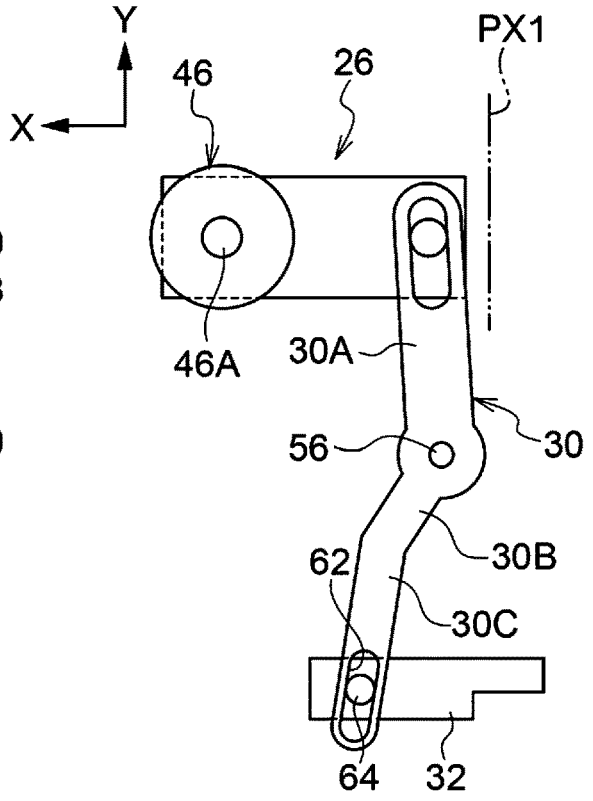
Figure 9E:
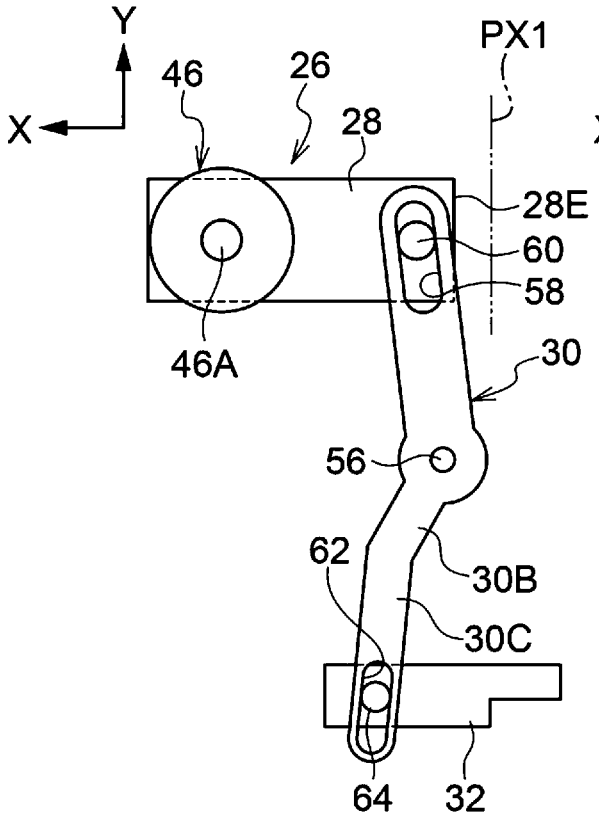
FIGS. 9E to 9G are schematic configuration views illustrating movement of the second link, the first link and the guide cam in a process of opening a covering when viewed in the apparatus depth direction (Z direction)
Figure 9F:
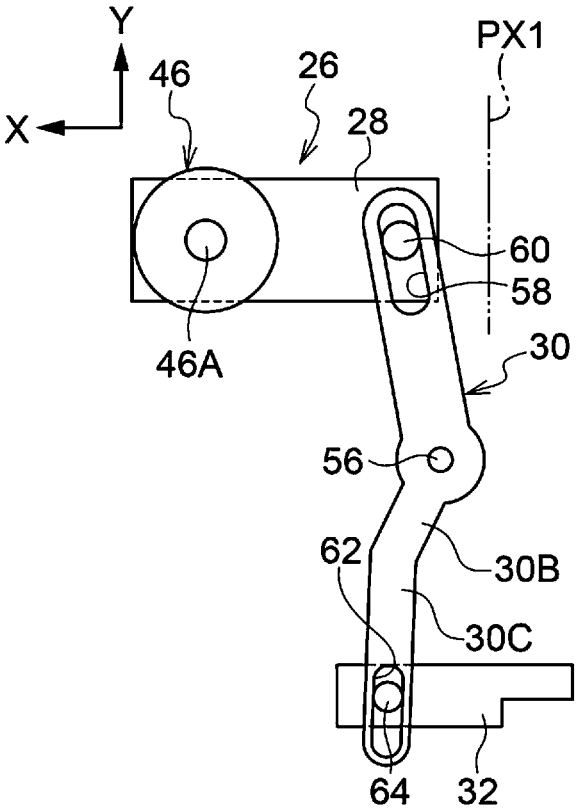
Figure 9G:
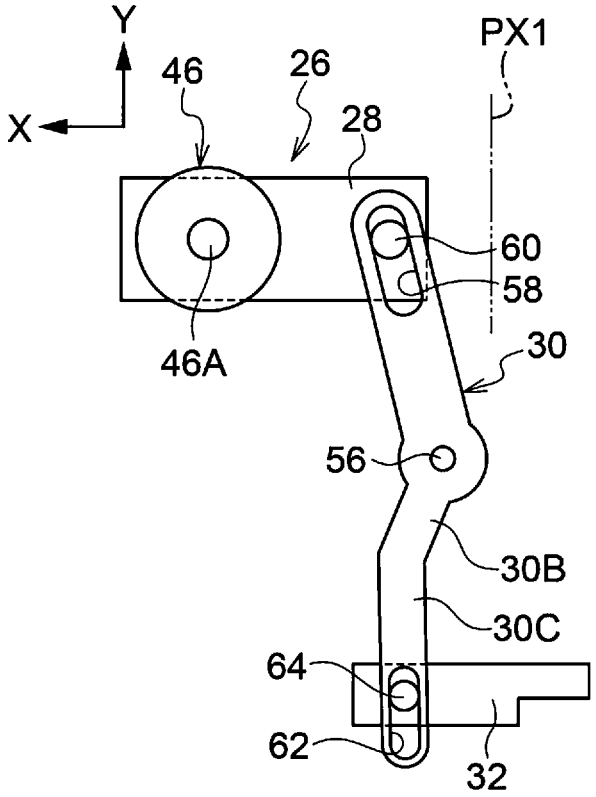
Figure 10A:
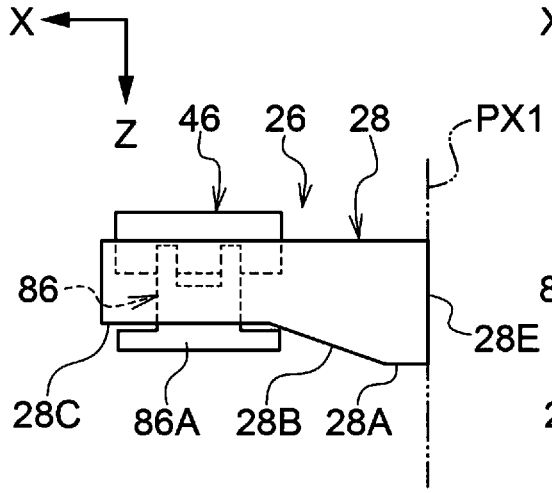
FIGS. 10A to 10E are schematic configuration views illustrating movement of the guide cam and a coupling in a process of opening a covering when viewed in the apparatus up-down direction (Y direction) in the drive switching device according to the first exemplary embodiment.
Figure 10B:
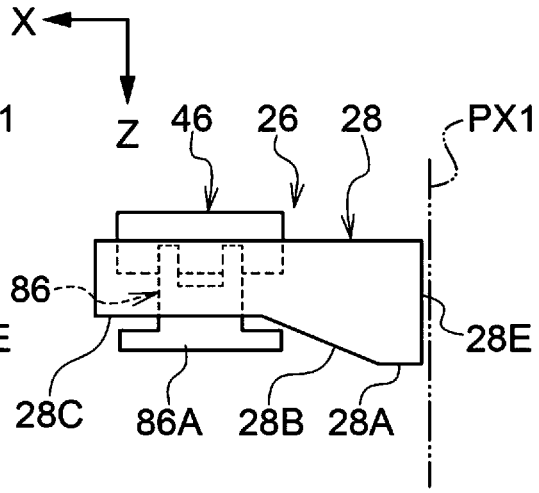
Figure 10C:
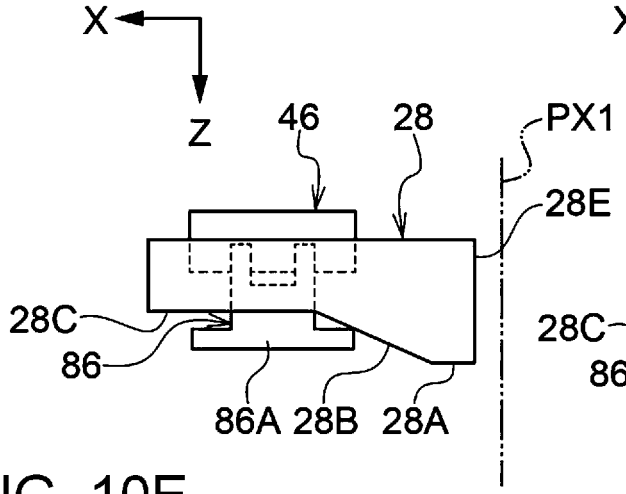
Figure 10D:
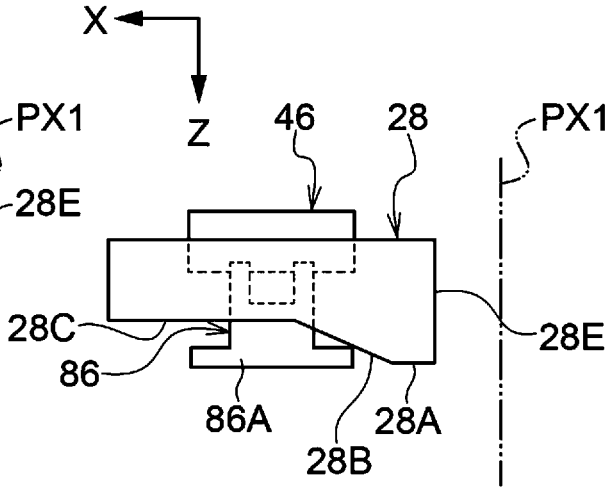
Figure 10E:
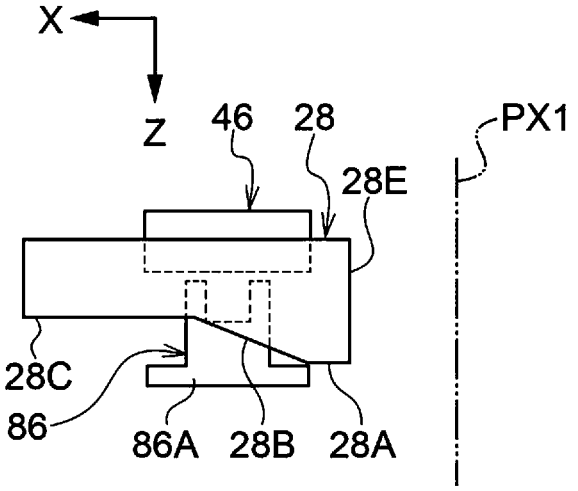

Hereinafter, the operation of the members included in the drive switching device 20 will be described more specifically. FIGS. 8A to 8D and FIGS. 8E to 8G illustrate the operation of the joint 24, the third link 34 and the second link 32 in a process of rotation of the covering 22 in a direction from the closed position P1 to the open position P2. The inside of the housing 12 is provided with an L-shaped frame 100 in a plan view (when viewed in the Y direction). The frame 100 is provided with an opening 102 for moving at least part of the joint 24 and the third link 34 outwardly of the frame 100. As illustrated in FIG. 8A, in a state where the covering 22 is rotated to be at the closed position P1, a rear face 32A of the second link 32 is disposed at a third position PX3. The joint 24 and the third link 34 are configured not to interfere with the frame 100 by movement in the opening 102.

As illustrated in FIGS. 8A to 8D, when the covering 22 starts to be rotated in a direction from the closed position P1 to the open position P2, the third link 34 has a greater amount of movement in an extension direction (for example, +Z side in the Z direction) of the covering 22 than an amount of movement in an opening direction (for example, −X side in the X direction) of the covering 22. For example, the third link 34 moves greatly in the opening 102 of the frame 100 in an extension direction (for example, +Z side in the Z direction) of the covering 22.

As illustrated in FIG. 8D and FIGS. 8E to 8G, from a middle of the rotation of the covering 22 in the direction toward the open position P2, the third link 34 has a greater amount of movement in the opening direction (for example, −X side in the X direction) of the covering 22 than the amount of movement in the extension direction (for example, +Z side in the Z direction) of the covering 22. For example, the third link 34 moves greatly in the opening 102 of the frame 100 in the opening direction (for example, −X side in the X direction) of the covering 22. Along with the movement of the third link 34, the second link 32 moves in the opening direction (for example, −X side in the X direction) of the covering 22. As an example, the second link 32 is configured to move in the width direction (X direction) of the housing 12 by a guide member which is not illustrated.

FIGS. 9A to 9D and FIGS. 9E to 9G illustrate the operation of the second link 32, the first link 30 and the guide cam 28 in a process of rotation of the covering 22 in a direction from the closed position P1 to the open position P2. The positions of the members in FIGS. 9A to 9D and FIGS. 9E to 9G correspond to respective positions of the members in FIG. 8D and FIGS. 8E to 8G.

As illustrated in FIGS. 9A to 9D and FIGS. 9E to 9G, when the covering 22 is rotated in a direction from the closed position P1 to the open position P2, the second link 32 moves to −X side in the width direction (X direction) of the housing 12. Along with the movement of the second link 32 to −X side, the end 31B (in other words, the end of the plate-shaped section 30C) of the first link 30 on the other side of the fulcrum 56 is pulled to −X side, thus the first link 30 rotates around the fulcrum 56. Accordingly, the end 31A (in other words, the end of the plate-shaped section 30A) of the first link 30 on one side of the fulcrum 56 rotates to +X side, and along with the rotation of the first link 30, the guide cam 28 moves to +X side. Due to such an operation, the front face 28E of the guide cam 28 moves from the first position PX1 to +X side.

FIGS. 10A to 10E illustrate the operation of the guide cam 28 of the release member 26 and the coupling 86 in a process of rotation of the covering 22 in a direction from the closed position P1 to the open position P2. In FIGS. 10A to 10E, the configuration of the components is schematically illustrated to facilitate understanding of the configuration. As illustrated in FIGS. 10A to 10E, when the covering 22 is rotated in a direction from the closed position P1 to the open position P2, the front face 28E of the guide cam 28 moves from the first position PX1 to +X side. Due to movement of the guide cam 28, the flange 86A of the coupling 86 moves from the second planar section 28C to +Z side through the inclined section 28B while being in contact with the first planar section 28A, then connection between the coupling 86 and the shaft 46A of the input gear 46 is released.

At this point, as illustrated in FIGS. 8A to 8D, FIGS. 8E to 8G, FIGS. 9A to 9D, FIGS. 9E to 9G, and FIGS. 10A to 10E, in a state where the covering 22 is rotated by a first predetermined angle in a direction from the closed position P1 to the open position P2, the release operation (in other words, release of the connection between the coupling 86 and the shaft 46A of the input gear 46) of the release member 26 by the guide cam 28 is started. For example, the first angle is preferably 20 degrees or more and 40 degrees or less, more preferably 25 degrees or more and 35 degrees or less, and further preferably 27 degrees or more and 33 degrees or less. In the first exemplary embodiment, the first angle is set around 30 degrees.

Furthermore, in a state where the covering 22 is rotated by a second angle greater than the first angle in a direction from the closed position P1 to the open position P2, the release operation of the release member 26 by the guide cam 28 is completed. For example, the second angle is preferably 45 degrees or more and 75 degrees or less, more preferably 50 degrees or more and 70 degrees or less, and further preferably 55 degrees or more and 65 degrees or less. In the first exemplary embodiment, the second angle is set around 60 degrees.

Figure 11A:
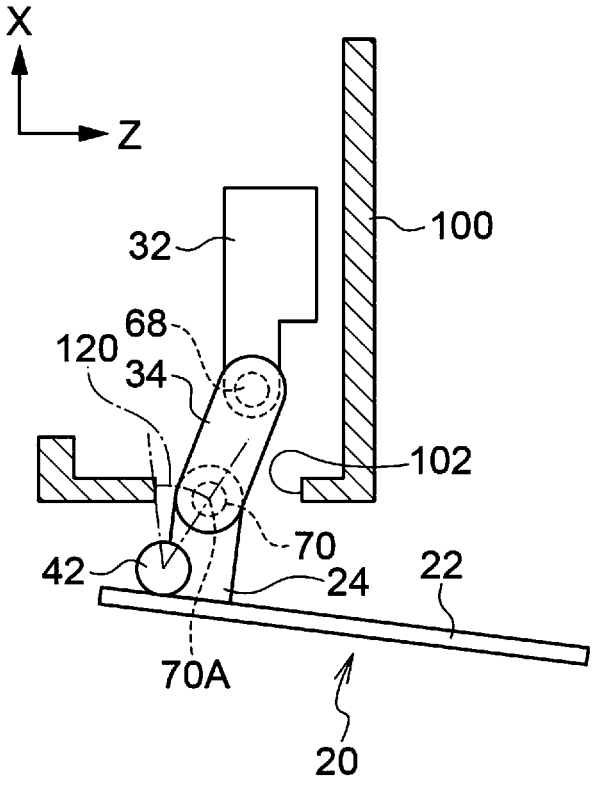
FIGS. 11A and 11B are schematic configuration views illustrating a relationship between the rotation angle of the covering relative to the closed position of the covering and a connection position between the joint and the third link in the drive switching device according to the first exemplary embodiment.
Figure 11B:
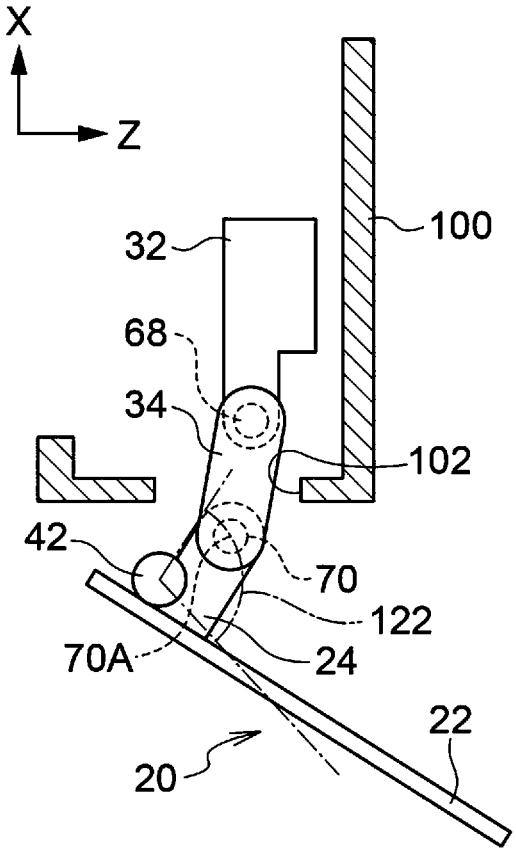

When the rotation angle, by which the covering 22 is rotated in a direction from the closed position P1 to the open position P2, is such an angle with which the release member 26 is not desired to be performed (in other words, the guide cam 28 is not desired to be moved to a release position), as illustrated in FIG. 11A, a center 70A of the projection 70 of the joint 24 is preferably set in an area 120. In addition, when the rotation angle, by which the covering 22 is rotated in a direction from the closed position P1 to the open position P2, is such an angle with which the release member 26 is desired to be performed (in other words, the guide cam 28 is desired to be moved to a release position), as illustrated in FIG. 11B, the center 70A of the projection 70 of the joint 24 is preferably set in an area 122. In other words, the area 122 is where the amount of change in operation of the joint 24 to −X side is large.

Figure 12:
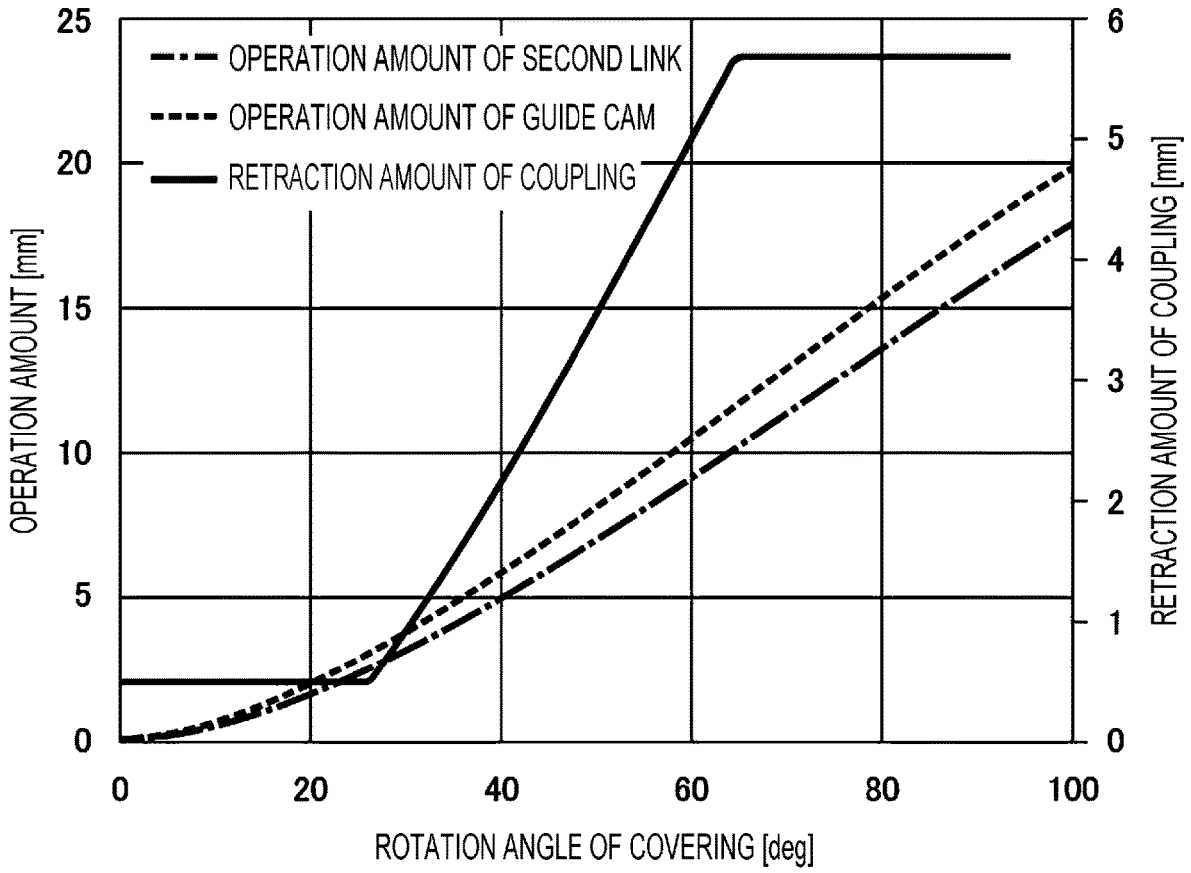
FIG. 12 is a graph illustrating a relationship between the rotation angle of the covering relative to the closed position of the covering, and each of the amount of operation of the second link, the amount of operation of the guide cam, and the amount of retraction of the coupling.

FIG. 12 illustrates a relationship between rotation angle of the covering 22 from the closed position P1, and each of the amount of operation of the second link 32, the amount of operation of the guide cam 28 and the amount of retraction of the coupling 86. As illustrated in FIG. 12, when the rotation angle of the covering 22 from the closed position P1 exceeds around 30 degrees, the amount of operation of the second link 32 and the amount of operation of the guide cam 28 increase, and the amount of retraction of the coupling 86 increases.

(Drive Switching Device in Comparative Example)

Here, the configuration and the problem of an image forming apparatus 200 including a drive switching device in a comparative example will be described.

Figure 13:
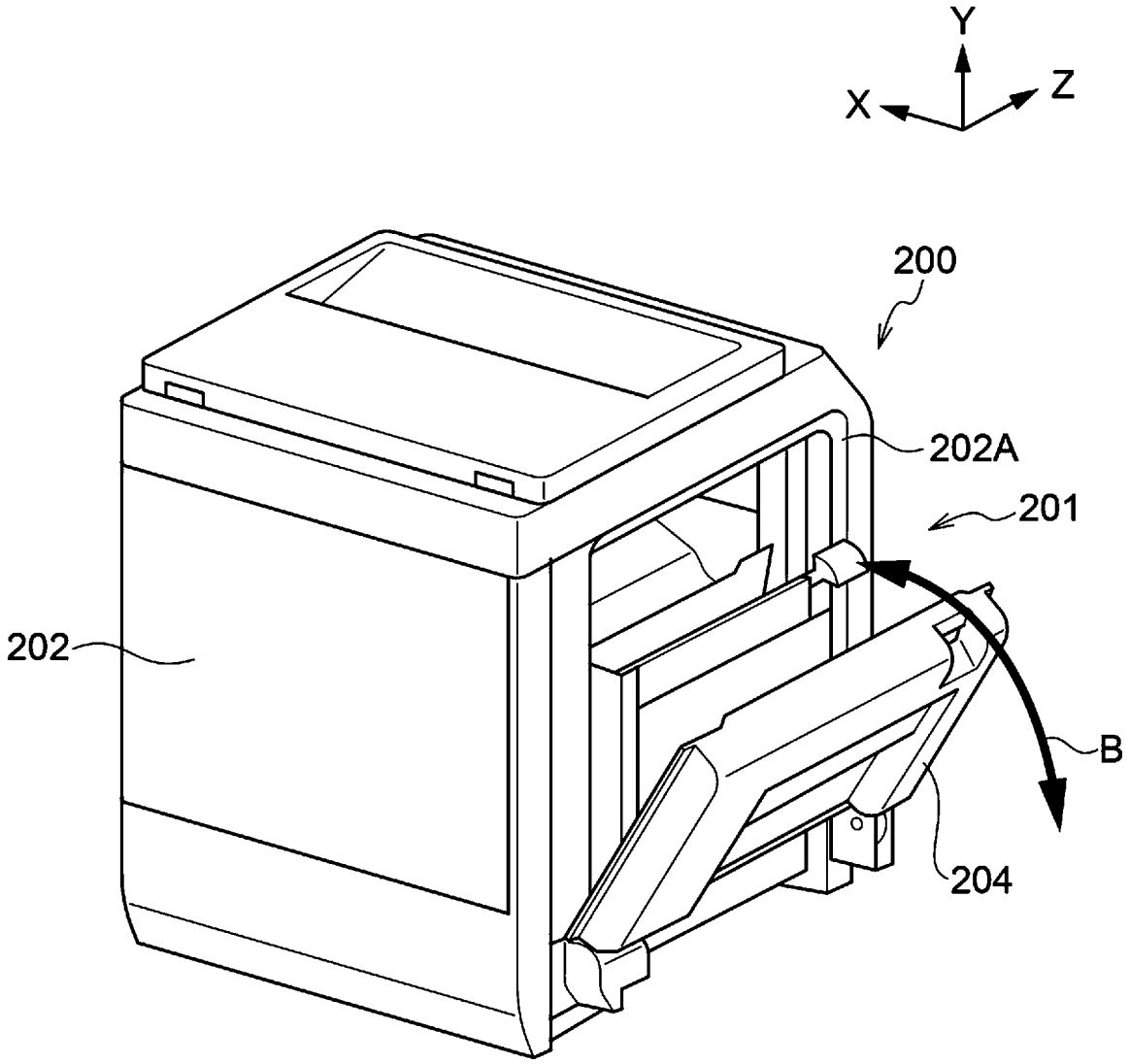
FIG. 13 is a schematic perspective view illustrating an appearance of an image forming apparatus including a drive switching device in a comparative example.

FIG. 13 illustrates an appearance of the image forming apparatus 200 including a drive switching device 201 in a comparative example. As illustrated in FIG. 13, the image forming apparatus 200 includes a housing 202. The image forming apparatus 200 is provided with a covering 204 to open and close an opening 202A of the housing 202. The covering 204 is rotatably supported by a support shaft 206 (see FIG. 14) that is disposed in the depth direction (Z direction) of the housing 202. The support shaft 206 is provided on the lower side of the covering 204 in the housing 202, and rotatably supports the covering 204 in an up-down direction (arrow B direction). In other words, when the covering 204 is opened, an upper side of the covering 204 is rotated in a downward direction.

When a sheet member as an example of a recording medium is stuck in the image forming apparatus 200, drive of a fixing unit 220 (see FIG. 14) needs to be released to reduce the operational ability of a user for handling the sheet member. For this reason, the image forming apparatus 200 is provided with the drive switching device 201 that releases the drive of the fixing unit 220 in conjunction with an operation of opening the covering 204.

Figure 14:
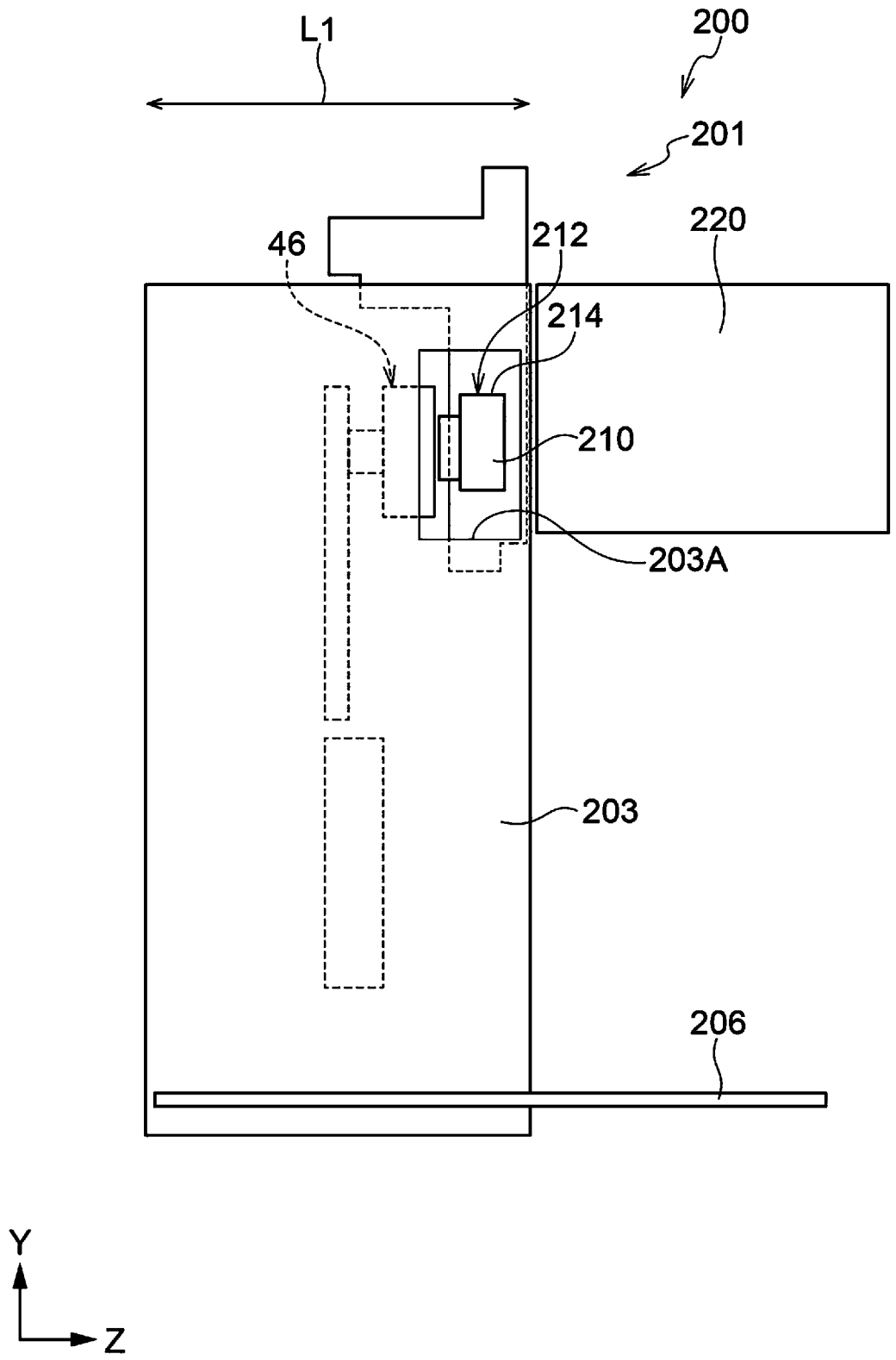
FIG. 14 is a schematic configuration view illustrating a positional relationship between an actuator and a release member in the drive switching device in a comparative example.

As illustrated in FIG. 14, the drive switching device 201 includes the covering 204, an actuator 210 fixed to the covering 204, and a release member 212 that disconnects the drive transmission path of a driver by the actuator 210. The release member 212 is disposed inwardly of a frame 203 inside the housing 202, and the covering 204 is disposed outwardly of the frame 203. For example, a component that transmits the drive of the driver is supported by the frame 203. Thus, the frame 203 is provided with an opening 203A, and disconnection and connection of the drive is made by the release member 212 in conjunction with the opening and closing of the covering 204.

Figure 15:
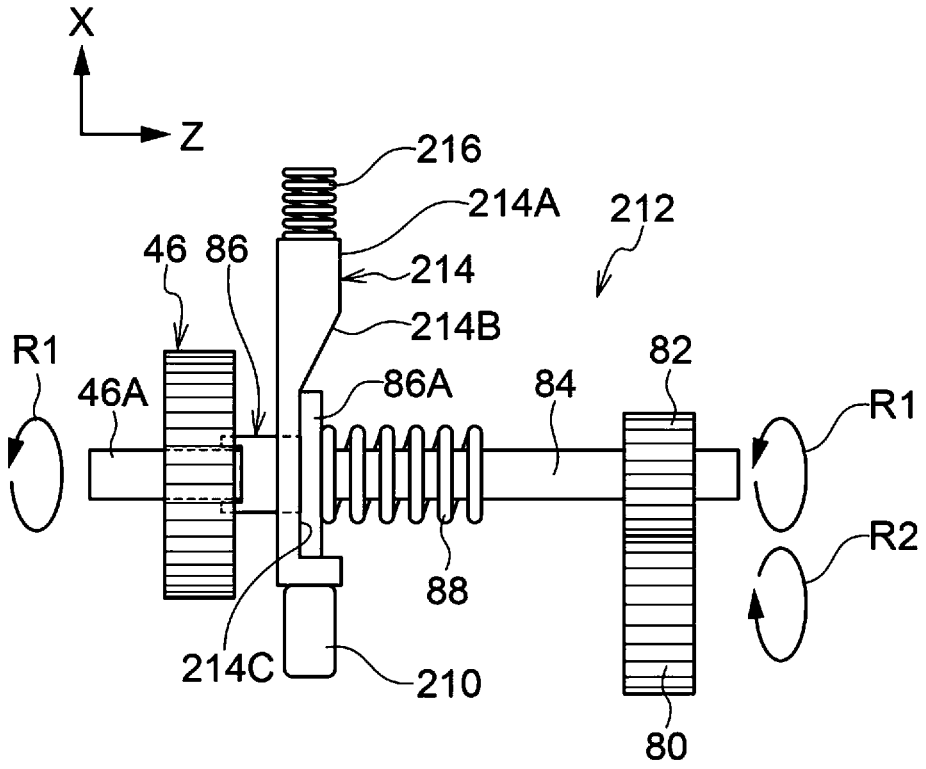
FIG. 15 is a schematic configuration view illustrating a state in which a coupling and an input gear are connected in the drive switching device in a comparative example.

The release member 212 includes a guide cam 214 that moves in conjunction with the movement of the actuator 210 (see FIG. 15). When viewed in a covering direction of the covering 204 (see FIG. 14), the actuator 210 and the guide cam 214 are provided at overlapping positions. The frame 203 is provided with the opening 203A, thus the actuator 210 can be moved to a position at which the actuator 210 is in contact with the guide cam 214.

As illustrated in FIG. 15, the release member 212 includes the guide cam 214, the delivery gear 82 engaged with the gear 80 of the fixing unit 220 (see FIG. 14), the shaft 84, the coupling 86, and the coil spring 88. The coupling 86 is pressed against the guide cam 214 by the force of the coil spring 88. The guide cam 214 includes, on the surface opposed to the gear 80, a first planar section 214A, an inclined section 214B, and a second planar section 214C from the far side with respect to the actuator 210. Furthermore, the release member 212 includes a coil spring 216 that serves as an urging member which urges the guide cam 214 to the actuator 210.

FIG. 15 illustrates a state of the release member 212 when the covering 204 has moved to the closed position. As illustrated in FIG. 15, when the covering 204 is closed, the actuator 210 attached to the covering 204 presses the guide cam 214 against the urging force of the coil spring 216, thereby moving the guide cam 214 to +X side in the width direction (X direction) of the housing 202. Consequently, the flange 86A of the coupling 86 is brought into contact with the second planar section 214C, and the coupling 86 is connected to the shaft 46A of the input gear 46. In this state, the rotational force of the input gear 46 is transmitted to the gear 80 through the delivery gear 82.

Figure 16:
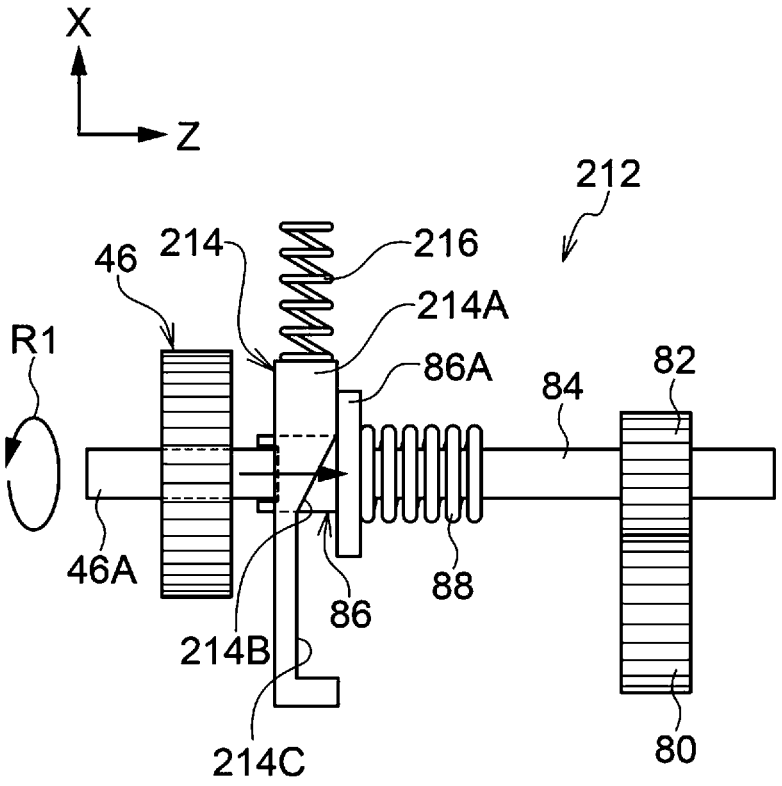
FIG. 16 is a schematic configuration view illustrating a state in which connection between the coupling and the input gear is released in the drive switching device in a comparative example.

FIG. 16 illustrates a state of the release member 212 when the covering 204 has moved to the open position. As illustrated in FIG. 16, when the covering 204 is opened, the actuator 210 attached to the covering 204 moves away from the guide cam 214, thus compression of the coil spring 216 is released, and the force of the coil spring 216 causes the guide cam 214 to move to −X side. Consequently, the flange 86A of the coupling 86 is brought into contact with the first planar section 214A of the guide cam 214, and the coupling 86 moves to +Z side, thus the connection between the coupling 86 and the shaft 46A of the input gear 46 is disconnected. Thus, the drive transmission path from the input gear 46 to the delivery gear 82 is disconnected, and the rotational force of the input gear 46 is not transmitted to the gear 80.

In the above image forming apparatus 200, length L1 in the apparatus depth direction (Z direction) of the frame 203 is increased. However, in recent years, due to downsizing of the image forming apparatus, there is no space for providing an opening at a position overlapping the release member in the frame when viewed in a covering direction of the covering, thus an opening and closing operation for the covering needs to be performed at a position away from the release member. When the support shaft which rotates the covering is close to the position of the opening of the frame, if a configuration is used in which the actuator is fixed to the covering, the actuator may interfere with the frame on a rotational path of the covering.

In the image forming apparatus 10 of the first exemplary embodiment, the housing 12 has been downsized, and the length of the frame 100 in the apparatus depth direction (Z direction) is smaller than the length of the frame 203 in the apparatus depth direction (Z direction) of the image forming apparatus 200 in a comparative example. For example, the length of the housing 12 in the depth direction (Z direction) of the image forming apparatus 10 is one fourth or less of the length of the housing 202 in the depth direction (Z direction) of the image forming apparatus 200 in a comparative example. For this reason, to avoid interference with the components of the driver close to the release member, an opening cannot be provided near the release member in the frame 100, thus the opening 102 needs to be provided at a position away from the release member 26.

Figure 17:
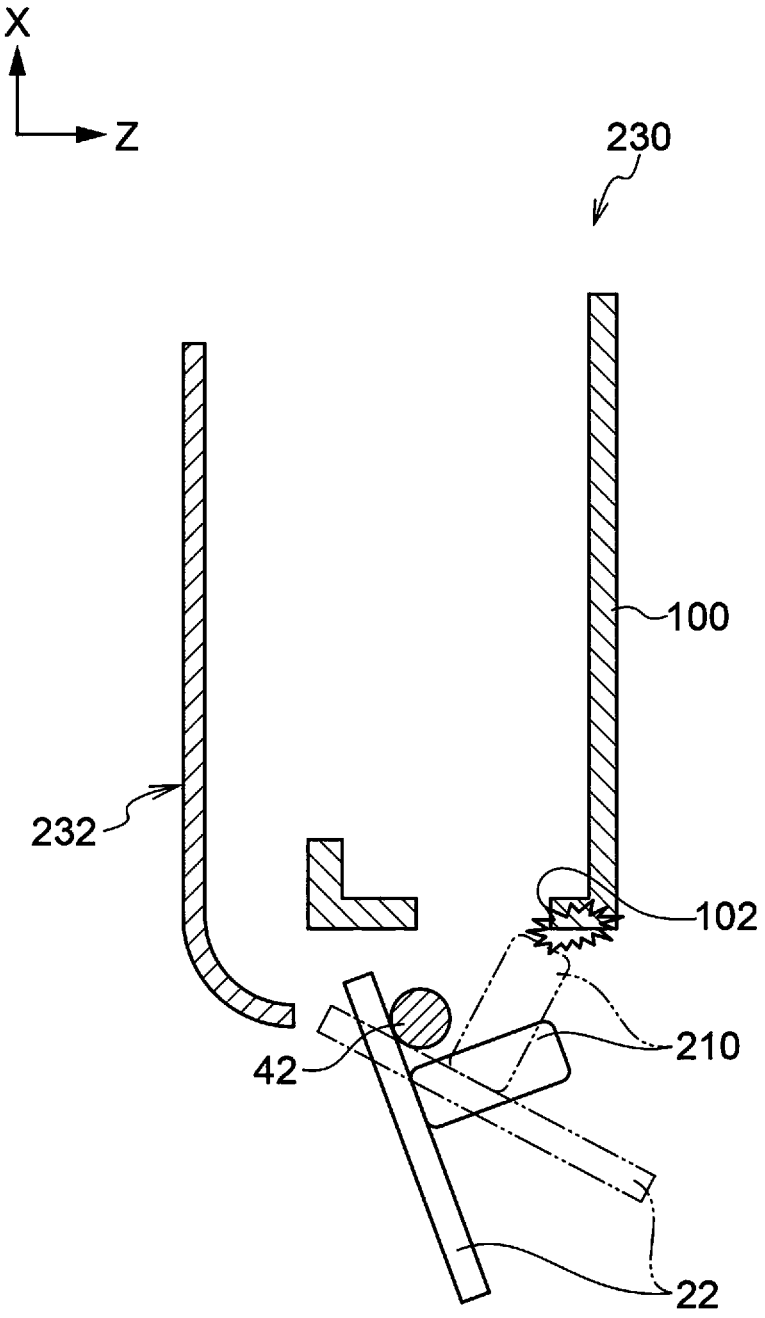
FIG. 17 is an illustration for explaining a state in which an actuator interferes with the frame when the drive switching device in a comparative example is applied to a covering rotatably supported by a support shaft in the apparatus up-down direction.

FIG. 17 illustrates the case where the drive switching device 201 in a comparative example is applied to the covering 22 which opens horizontally as in the first exemplary embodiment. As illustrated in FIG. 17, the covering 22 is rotatably supported by the support shaft 42 disposed in the up-down direction, and the actuator 210 is attached to the rear surface of the covering 22. In this case, when the covering 22 is rotated in a closing direction, the actuator 210 may come into contact (interfere) with the edge of the opening 102 of the frame 100. Therefore, it is difficult to avoid interference between the actuator 210 and the frame 100 on a rotational path of the covering 22.

(Operation and Effect of First Exemplary Embodiment)

Next, the operation and the effect of the first exemplary embodiment will be described.

The drive switching device 20 includes the covering 22 rotatably provided on the support shaft 42 provided in the housing 12, and the joint 24 attached to the covering 22. The joint 24 receives an input of displacement caused by rotation of the covering 22. The drive switching device 20 is provided with the release member 26 including the guide cam 28 that moves in conjunction with the movement of the joint 24. The release member 26 is provided inside the housing 12 in a direction apart from the joint 24. In addition, as multiple links to be connected to the joint 24 and the guide cam 28, the drive switching device 20 includes the first link 30, the second link 32, and the third link 34 in that order from the side of the guide cam 28. When the covering 22 is rotated, the first link 30, the second link 32, and the third link 34 move the guide cam 28 in the direction opposite to the direction in which the joint 24 moves.

In the drive switching device 20, when the covering 22 is rotated toward the open position P2, the first link 30, the second link 32, and the third link 34 operate in conjunction with the movement of the joint 24, thereby causing the guide cam 28 to move in the opposite direction (for example, +X side) to the direction (for example, −X side) in which the joint 24 moves. The movement of the guide cam 28 disconnects the drive transmission path of the input gear 46.

Thus, in the drive switching device 20, it is possible to prevent interference between the joint 24 and the frame 100 of the housing 12 on a rotational path of the covering 22, as compared to the configuration in which the actuator to operate the release member is fixed to the covering. For example, as illustrated in FIG. 17, it is possible to prevent interference between the joint 24 and the frame 100 of the housing 12 on a rotational path of the covering 22, as compared to the configuration in which the actuator 210 to operate the guide cam 214 of the release member 212 is fixed to the covering 204.

The drive switching device 20 is provided with the covering 22 rotatably provided on the support shaft 42 provided in the housing 12, and the joint 24 attached to the covering 22. The joint 24 receives an input of displacement when the covering 22 is rotated toward the third link 34 in a direction to the open position P2. In addition, the drive switching device 20 is provided with the release member 26 disposed inside the housing 12 in a direction apart from the joint 24. The release member 26 includes the guide cam 28 that moves in conjunction with the movement of the joint 24.

The drive switching device 20 is provided with the first link 30 rotatably provided around the fulcrum 56, and the first link 30 moves the guide cam 28 connected to one side of the fulcrum 56. The drive switching device 20 is provided with the second link 32 connected to the other side of the fulcrum 56 in the first link 30, and the third link 34 connected to and rotatably supported by the second link 32 and the joint 24.

In the release member 26, when the covering 22 is rotated toward the open position P2, the first link 30, the second link 32, and the third link 34 operate in conjunction with the movement of the joint 24, thereby causing the guide cam 28 to move. The movement of the guide cam 28 releases the drive of the driver, that is, disconnects the drive transmission path of the input gear 46.

More specifically, as illustrated in FIGS. 8A to 8D and FIGS. 8E to 8G, when the covering 22 is rotated in a direction from the closed position P1 to the open position P2, the third link 34 moves in conjunction with the movement of the joint 24, and the second link 32 moves to −X side in the width direction (X direction) of the housing 12 by the third link 34.

As illustrated in FIGS. 9A to 9D and FIGS. 9E to 9G, when the covering 22 is rotated in a direction from the closed position P1 to the open position P2, along with the movement of the second link 32 to −X side, the end 31B of the first link 30 on the other side of the fulcrum 56 is pulled to −X side, thus the first link 30 rotates around the fulcrum 56. Thus, the end 31A of the first link 30 on the one side of the fulcrum 56 rotates to +X side, and the guide cam 28 moves to +X side along with the rotation of the first link 30. Thus, the front face 28E of the guide cam 28 moves from the first position PX1 to +X side.

As illustrated in FIGS. 10A to 10E, due to the movement of the guide cam 28 to +X side, the flange 86A of the coupling 86 is brought into contact with the sections from the second planar section 28C to the first planar section 28A through the inclined section 28B, thereby causing the coupling 86 to move to +Z side. Thus, the connection between the coupling 86 and the shaft 46A of the input gear 46 is released.

Thus, in the drive switching device 20, it is possible to prevent the joint 24, the first link 30, the second link 32, and the third link 34 from interfering with the frame 100 of the housing 12 on a rotational path of the covering 22, as compared to the configuration in which the actuator to operate the release member is fixed to the covering. For example, as illustrated in FIG. 17, it is possible to prevent the joint 24, the first link 30, the second link 32, and the third link 34 from interfering with the frame 100 of the housing 12 on a rotational path of the covering 22, as compared to the configuration in which the actuator 210 to operate the guide cam 214 of the release member 212 is fixed to the covering 204.

The end 31A of the first link 30 on one side of the fulcrum 56, in other words, the end 31A of the plate-shaped section 30A is provided with the first long hole 58. The guide cam 28 is provided with the first projection 60 which is inserted into the first long hole 58. Thus, the first projection 60 is relatively movable in the longitudinal direction of the first long hole 58 in response to the movement of the first link 30. The end 31B of the first link 30 on the other side of the fulcrum 56, in other words, the plate-shaped section 30C is provided with the second long hole 62. The second link 32 is provided with the second projection 64 which is inserted into the second long hole 62. Thus, the second projection 64 is relatively movable in the longitudinal direction of the second long hole 62 in response to the movement of the second link 32.

Therefore, in the drive switching device 20, the timing of moving the guide cam 28 can be adjusted according to the position of rotation of the covering 22 in a direction to the open position P2, as compared to the configuration in which a connection part between the first link and guide cam and a connection part between the first link and the second link are not moved in an axial direction. Furthermore, in the drive switching device 20, a spring for urging the guide cam 28 to the support shaft 42 is unnecessary, as compared to the configuration in which a connection part between the first link and guide cam and a connection part between the first link and the second link are not moved in an axial direction.

In the drive switching device 20, when viewed in a direction along the axial direction of the fulcrum 56, the first link 30 is curved on one side and the other side of the fulcrum 56. Thus, the first link 30 when rotated around the fulcrum 56 has a smaller movement range on the one side and a smaller movement range on the other side, as compared to when the first link has a straight shape as viewed in a direction along the axial direction of the fulcrum. Therefore, it is possible to avoid interference of the first link 30 with the components in the housing 12 even with rotation of the first link 30 around the fulcrum 56, as compared to when the first link has a straight shape as viewed in a direction along the axial direction of the fulcrum.

Thus, in the drive switching device 20, the space in a direction of rotation of the first link 30 around the fulcrum 56 can be saved, as compared to when the first link has a straight shape as viewed in a direction along the axial direction of the fulcrum.

In the drive switching device 20, the direction of the first long hole 58 is aligned with the direction of the second long hole 62, the extension area of the first long hole 58 includes the fulcrum 56, and the extension area of the second long hole 62 is displaced from the fulcrum 56.

Thus, in the drive switching device 20, the space in a direction of rotation of the first link 30 around the fulcrum 56 can be saved, as compared to the configuration in which the extension areas of the first long hole and the second long hole are provided with a fulcrum.

In the drive switching device 20, the support shaft 42 is disposed in the up-down direction (Y direction) of the housing 12.

Thus, in the drive switching device 20, even when the support shaft is disposed in the up-down direction of the housing, and the space in a direction crossing the up-down direction of the housing is small, it is possible to prevent the joint 24, the first link 30, the second link 32, and the third link 34 from interfering with the frame 100 of the housing 12 on a rotational path of the covering 22. For example, as illustrated in FIG. 17, it is possible to prevent the joint 24, the first link 30, the second link 32, and the third link 34 from interfering with the frame 100 of the housing 12 on a rotational path of the covering 22, as compared to the configuration in which the actuator 210 to operate the guide cam 214 of the release member 212 is fixed to the covering 204.

In the drive switching device 20, the joint 24 and the release member 26 are disposed at separate positions in the up-down direction (Y direction) of the housing 12. When viewed in a covering direction of the covering 22 (see FIG. 3), the joint 24 is disposed on one side of the housing 12 with respect to the support shaft 42, and the release member 26 is disposed on the other side of the housing 12 with respect to the support shaft 42. In addition, the guide cam 28 and the second link 32 move in a horizontal direction.

Thus, in the drive switching device 20, even when an input unit is disposed on one side of the housing with respect to the support shaft, and a release member is disposed on the other side of the housing with respect to the support shaft, it is possible to prevent the joint 24, the first link 30, the second link 32, and the third link 34 from interfering with the frame 100 of the housing 12 on a rotational path of the covering 22.

In the drive switching device 20, when viewed in a covering direction (X direction) of the covering 22 (see FIG. 3), the step 30D is provided between the section to be connected to the guide cam 28 and the section to be connected to the second link 32.

Therefore, in the drive switching device 20, increase in the number of components can be reduced and space can be saved, as compared to when the first link is formed in a linear shape as viewed in a covering direction of the covering.

In the drive switching device 20, when the covering 22 starts to be rotated in a direction toward the open position P2, the third link 34 has a greater amount of movement in an extension direction (for example, +Z side in the Z direction) of the covering 22 than the amount of movement in an opening direction (for example, −X side in the X direction) of the covering 22 (see FIGS. 8A to 8D and FIGS. 8E to 8G). In addition, from a middle of the rotation of the covering 22 in the direction toward the open position P2, the third link 34 has a greater amount of movement in the opening direction (for example, −X side in the X direction) of the covering 22 than the amount of movement in the extension direction (for example, +Z side in the Z direction) of the covering 22 (see FIGS. 8A to 8D and FIGS. 8E to 8G).

Thus, in the drive switching device 20, when the covering is moved from the closed position to the open position, it is possible to prevent interference between the third link 34 and the frame 100 of the housing 12 on a rotational path of the covering 22, as compared to when the third link moves in the same direction from the closed position to the open position.

In the drive switching device 20, in a state where the covering 22 is rotated by the first predetermined angle (for example, around 30 degrees) in a direction from the closed position P1 to the open position P2, the release operation of the release member 26 by the guide cam 28 is started. Furthermore, in a state where the covering 22 is rotated by the second angle (for example, around 60 degrees) greater than the first angle in a direction from the closed position P1 to the open position P2, the release operation of the release member 26 by the guide cam 28 is completed (see FIGS. 9A to 9D, FIGS. 9E to 9G, and FIGS. 10A to 10E).

Therefore, in the drive switching device 20, when the covering 22 is rotated in a direction to the open position P2, the drive of the driver can be released early by the release member 26, in other words, the drive transmission path of the input gear 46 can disconnected early, as compared to the configuration in which the release operation of the release member is completed when the covering is rotated to the open position.

The image forming apparatus 10 includes the drive switching device 20. Furthermore, the image forming apparatus 10 includes, inside the housing 12, a transporter that transports a sheet member, an image former that forms an image on a sheet member, and a fixing unit 18 that fixes a toner image formed on the sheet member by driving the driver (see FIG. 2).

Thus, in the image forming apparatus 10, when the covering 22 is moved to the open position P2, the drive of the fixing unit 18 by the driver is released.

<Others>

The present disclosure is not limited to the exemplary embodiment, and design change can be made as appropriate within a range not departing from the gist of the present disclosure.

In the first exemplary embodiment, the end 31A of the first link 30 on one side of the fulcrum 56 is provided with the first long hole 58, and the first projection 60 of the guide cam 28 is inserted into the first long hole 58; however, the present disclosure is not limited to this configuration. For example, a configuration may be adopted in which the guide cam is provided with the first long hole, and the first projection provided at the end of the first link on one axial side of the fulcrum is inserted into the first long hole.

In the first exemplary embodiment, the end 31B of the first link 30 on the other side of the fulcrum 56 is provided with the second long hole 62, and the second projection 64 of the second link 32 is inserted into the second long hole 62; however, the present disclosure is not limited to this configuration. For example, a configuration may be adopted in which the second link is provided with the second long hole, and the second projection provided at the end of the first link on the other side of the first link is inserted into the second long hole.

In the first exemplary embodiment, the fulcrum 56 is provided in an extended area of the first long hole 58 in the first link 30, but is displaced from an extended area of the second long hole 62; however, the present disclosure is not limited to this configuration. For example, a configuration may be adopted in which the fulcrum is provided in an extended area of the second long hole in the first link 30, and displaced from an extended area of the first long hole.

In the first exemplary embodiment, the first link 30, the second link 32 and the third link 34 are provided; however, the present disclosure is not limited to this configuration. For example, in a configuration in which the guide cam 28 is moved in the same direction as in the first exemplary embodiment in conjunction with the movement of the joint 24 at the time of rotation of the covering 22, the number of links may be changed. Although the covering 22 is supported by the support shaft 42 in the up-down direction, the direction of the support shaft which rotates the covering may be changed. For example, the covering may be configured to be rotated by a support shaft disposed in a horizontal direction.

In the first exemplary embodiment, when the covering 22 is moved to the open position P2, the drive of the fixing unit 18 by the driver is released; however, the present disclosure is not limited to this configuration. For example, in a sheet transport device including a transporter that transports a sheet member as an example of a recording medium, the drive of the transporter may be released (in other words, the drive transmission path of the transporter may be disconnected) by a release member. For example, in an image forming apparatus including, inside its housing, a transporter that transports a sheet member as an example of a recording medium, and an image former that forms an image on a sheet member, the release member may be configured to release the drive of a driver that drives part of a transporter or an image former.

In the first exemplary embodiment, an example has been described in which the drive switching device is applied to the image forming apparatus; however, the present disclosure is not limited to this configuration. For example, the drive switching device of the present disclosure is applicable to an apparatus other than an image former, such as an optional sheet feed device and a post-processing device for binding, stapling, folding.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

<Appendix>

(((1)))

A drive switching device comprising:

a covering member that is rotatably provided on a support shaft provided in a housing including a driver, and is rotatable from a closed position for covering an inside of the housing to an open position for exposing the inside of the housing;

an input unit that is provided in the covering member, and receives an input of displacement caused by rotation of the covering member;

a release member provided in a direction apart from the input unit inside the housing and including a cam that moves in conjunction with movement of the input unit, the release member being configured to, upon rotation of the covering member toward the open position, disconnect a drive transmission path of the driver by the cam; and a plurality of links connected to the input unit and the cam, the plurality of links being configured to, upon rotation of the covering member, move the cam in an opposite direction to a direction in which the input unit is moved.

(((2)))

A drive switching device comprising:

a covering member that is rotatably provided on a support shaft provided in a housing including a driver, and is rotatable from a closed position for covering an inside of the housing to an open position for exposing the inside of the housing;

an input unit that is provided in the covering member, and receives an input of displacement when the covering member is rotated in a direction toward the open position;

a release member provided in a direction apart from the input unit inside the housing and including a cam that moves in conjunction with movement of the input unit, the release member being configured to, upon rotation of the covering member toward the open position, release drive of the driver by the cam;

a first link rotatably provided around a fulcrum as a center to move the cam connected to one side of the fulcrum;

a second link connected to the other side of the fulcrum in the first link; and a third link connected to and rotatably supported by the second link and the input unit.

(((3)))

The drive switching device according to (((2))), wherein a first long hole is provided in one of the cam and an end of the first link on the one side of the fulcrum, and a first projection is inserted in the first long hole, the first projection being provided in the other of the cam and the axial end of the first link on the one side of the fulcrum, and a second long hole is provided in one of the second link and an end of the first link on the other side of the fulcrum, and a second projection is inserted in the second long hole, the first projection being provided in the other of the second link and the end of the first link on the other side of the fulcrum.

(((4)))

The drive switching device according to (((2))) or (((3))), wherein when viewed in a direction along an axial direction of the fulcrum, the first link is curved on the one side and the other side of the fulcrum.

(((5)))

The drive switching device according to (((3))) or (((4))), wherein a direction of the first long hole is aligned with a direction of the second long hole, and an extension area of one of the first long hole and the second long hole includes the fulcrum, and an extension area of the other of the first long hole and the second long hole is displaced from the fulcrum.

(((6)))

The drive switching device according to any one of (((2))) to (((5))), wherein the support shaft is disposed in an up-down direction of the housing.

(((7)))

The drive switching device according to (((6))), wherein the input unit and the release member are disposed at positions apart in an up-down direction of the housing, when viewed in a covering direction of the covering member, the input unit is disposed on one side of the housing with respect to the support shaft, and the release member is disposed on the other side of the housing with respect to the support shaft, and the cam and the second link are movable in a horizontal direction.

(((8)))

The drive switching device according to (((6))) or (((7))), wherein when viewed in a covering direction of the covering member, the first link is provided with a step between a section connected to the cam and a section connected to the second link.

(((9)))

The drive switching device according to any one of (((2))) to (((8))), wherein when the covering member starts to be rotated in a direction toward the open position, the third link has a greater amount of movement in an extension direction of the covering member than an amount of movement in an opening direction of the covering member, and from a middle of rotation of the covering member in the direction toward the open position, the third link has a greater amount of movement in the opening direction of the covering member than the amount of movement in the extension direction of the covering member.

(((10)))

The drive switching device according to any one of (((2))) to (((9))), wherein a release operation of the release member by the cam starts in a state where the covering member is rotated by a predetermined first angle in a direction from the closed position to the open position, and the release operation of the release member by the cam is completed in a state where the covering member is rotated by a second angle greater than the first angle in the direction from the closed position to the open position.

(((11)))

A sheet transport device comprising:

the drive switching device according to any one of (((1))) to (((10)));

a transporter that is provided inside the housing, and transports a sheet, wherein the driver drives the transporter.

(((12)))

An image forming apparatus comprising:

the drive switching device according to any one of (((1))) to (((10)));

a transporter that is provided inside the housing, and transports a recording medium; and an image former that is provided inside the housing, and forms an image on the recording medium, wherein the driver drives part of the transporter and the image former.

(((13)))

An image forming apparatus comprising:

the drive switching device according to any one of (((1))) to (((10)));

a transporter that is provided inside the housing, and transports a recording medium;

an image former that is provided inside the housing, and forms an image on the recording medium; and a fixing part that is provided in the image former, and fixes a toner image formed on the recording medium by drive of the driver.

What is claimed is:

1. A drive switching device comprising:

a covering member that is rotatably provided on a support shaft provided in a housing including a driver, and is rotatable from a closed position for covering an inside of the housing to an open position for exposing the inside of the housing;

an input unit that is provided in the covering member, and receives an input of displacement caused by rotation of the covering member;

a release member provided in a direction apart from the input unit inside the housing and including a cam that moves in conjunction with movement of the input unit, the release member being configured to, upon rotation of the covering member toward the open position, disconnect a drive transmission path of the driver by the cam; and a plurality of links connected to the input unit and the cam, the plurality of links being configured to, upon rotation of the covering member, move the cam in an opposite direction to a direction in which the input unit is moved.

2. A drive switching device comprising:

a covering member that is rotatably provided on a support shaft provided in a housing including a driver, and is rotatable from a closed position for covering an inside of the housing to an open position for exposing the inside of the housing;

an input unit that is provided in the covering member, and receives an input of displacement when the covering member is rotated in a direction toward the open position;

a release member provided in a direction apart from the input unit inside the housing and including a cam that moves in conjunction with movement of the input unit, the release member being configured to, upon rotation of the covering member toward the open position, release drive of the driver by the cam;

a first link rotatably provided around a fulcrum as a center to move the cam connected to one side of the fulcrum;

a second link connected to the other side of the fulcrum in the first link; and a third link connected to and rotatably supported by the second link and the input unit.

3. The drive switching device according to claim 2, wherein a first long hole is provided in one of the cam and an axial end of the first link on the one side of the fulcrum, and a first projection is inserted in the first long hole, the first projection being provided in the other of the cam and the axial end of the first link on the one side of the fulcrum, and a second long hole is provided in one of the second link and an end of the first link on the other side of the fulcrum, and a second projection is inserted in the second long hole, the first projection being provided in the other of the second link and the end of the first link on the other side of the fulcrum.

4. The drive switching device according to claim 2, wherein when viewed in a direction along an axial direction of the fulcrum, the first link is curved on the one side and the other side of the fulcrum.

5. The drive switching device according to claim 3, wherein a direction of the first long hole is aligned with a direction of the second long hole, and an extension area of one of the first long hole and the second long hole includes the fulcrum, and an extension area of the other of the first long hole and the second long hole is displaced from the fulcrum.

6. The drive switching device according to claim 2, wherein the support shaft is disposed in an up-down direction of the housing.

7. The drive switching device according to claim 6, wherein the input unit and the release member are disposed at positions apart in an up-down direction of the housing, when viewed in a covering direction of the covering member, the input unit is disposed on one side of the housing with respect to the support shaft, and the release member is disposed on the other side of the housing with respect to the support shaft, and the cam and the second link are movable in a horizontal direction.

8. The drive switching device according to claim 7, wherein when viewed in a covering direction of the covering member, the first link is provided with a step between a section connected to the cam and a section connected to the second link.

9. The drive switching device according to claim 2, wherein when the covering member starts to be rotated in a direction toward the open position, the third link has a greater amount of movement in an extension direction of the covering member than an amount of movement in an opening direction of the covering member, and from a middle of rotation of the covering member in the direction toward the open position, the third link has a greater amount of movement in the opening direction of the covering member than the amount of movement in the extension direction of the covering member.

10. The drive switching device according to claim 9, wherein a release operation of the release member by the cam starts in a state where the covering member is rotated by a predetermined first angle in a direction from the closed position to the open position, and the release operation of the release member by the cam is completed in a state where the covering member is rotated by a second angle greater than the first angle in the direction from the closed position to the open position.

11. A sheet transport device comprising:

the drive switching device according to claim 1; and a transporter that is provided inside the housing, and transports a sheet, wherein the driver drives the transporter.

12. A sheet transport device comprising:

the drive switching device according to claim 2; and a transporter that is provided inside the housing, and transports a sheet, wherein the driver drives the transporter.

13. A sheet transport device comprising:

the drive switching device according to claim 3; and a transporter that is provided inside the housing, and transports a sheet, wherein the driver drives the transporter.

14. A sheet transport device comprising:

the drive switching device according to claim 4; and a transporter that is provided inside the housing, and transports a sheet, wherein the driver drives the transporter.

15. A sheet transport device comprising:

the drive switching device according to claim 5; and a transporter that is provided inside the housing, and transports a sheet, wherein the driver drives the transporter.

16. A sheet transport device comprising:

the drive switching device according to claim 6; and a transporter that is provided inside the housing, and transports a sheet, wherein the driver drives the transporter.

17. A sheet transport device comprising:

the drive switching device according to claim 7; and a transporter that is provided inside the housing, and transports a sheet, wherein the driver drives the transporter.

18. A sheet transport device comprising:

the drive switching device according to claim 8; and a transporter that is provided inside the housing, and transports a sheet, wherein the driver drives the transporter.

19. An image forming apparatus comprising:

the drive switching device according to claim 1;

a transporter that is provided inside the housing, and transports a recording medium; and an image former that is provided inside the housing, and forms an image on the recording medium, wherein the driver drives part of the transporter and the image former.

20. An image forming apparatus comprising:

the drive switching device according to claim 1;

a transporter that is provided inside the housing, and transports a recording medium;

an image former that is provided inside the housing, and forms an image on the recording medium; and a fixing part that is provided in the image former, and fixes a toner image formed on the recording medium by drive of the driver.

* * * * *